US010697183B1

(12) United States Patent
Ferguson

(10) Patent No.: US 10,697,183 B1
(45) Date of Patent: Jun. 30, 2020

(54) METHOD AND APPARATUS FOR A WALL PANEL SYSTEM

(71) Applicant: Associated Architectural Products, Inc., Columbus, MS (US)

(72) Inventor: T. Richard Ferguson, Columbus, MS (US)

(73) Assignee: Associated Architectural Products, Inc., Columbus, MS (US)

( * ) Notice: Subject to any disclaimer, the term of this patent is extended or adjusted under 35 U.S.C. 154(b) by 0 days.

(21) Appl. No.: 16/450,894

(22) Filed: Jun. 24, 2019

Related U.S. Application Data

(63) Continuation-in-part of application No. 16/029,086, filed on Jul. 6, 2018, now Pat. No. 10,329,773.

(51) Int. Cl.
*E04F 13/24* (2006.01)
*E04F 13/08* (2006.01)
(Continued)

(52) U.S. Cl.
CPC ..... *E04F 13/26* (2013.01); *E04B 1/34321* (2013.01); *E04F 13/083* (2013.01);
(Continued)

(58) Field of Classification Search
CPC . E04F 13/0801; E04F 13/0803; E04F 13/081; E04F 13/0814; E04F 13/083; E04F 13/0851; E04F 13/086; E04F 13/0891; E04F 13/24; E04F 13/30; E04B 2001/1942; E04B 2001/1975; E04B 2001/2436; E04B 2001/2448; E04B 2001/2457; E04B 2002/7462; E04B 2002/7474; E04B 2002/7466
(Continued)

(56) References Cited

U.S. PATENT DOCUMENTS 4,459,790 A * 7/1984 Vermillion ..... E04B 2/825 52/241
4,472,917 A * 9/1984 Alderton ..... B62D 27/065 24/525
(Continued)

FOREIGN PATENT DOCUMENTS

CA 2799496 A1 * 12/2011 ..... E04F 13/0817
GB 1409713 10/1975
(Continued)

OTHER PUBLICATIONS

Panel Specialists, Inc., Wall Panel Systems, Sep. 10, 2016 (date published on internet retrieved from Internet Wayback Machine) (https://panelspec.com/wp-content/uploads/2016/08/PSI-Wall-Panel-Brochure.pdf).‡
(Continued)

*Primary Examiner* — Ryan D Kwiecinski
(74) *Attorney, Agent, or Firm* — Middleton Reutlinger

(57) ABSTRACT

An apparatus and method for a wall panel system having a plurality of wall panels arranged within a framework. The wall panels may include a plurality of retention devices releasably engaging the framework to position the wall panels relative to the wall panel system. One or more of the retention devices may be actuated to engage and disengage from the framework. The wall panel system may include trim releasably engaging the framework.

15 Claims, 16 Drawing Sheets

(51) Int. Cl.
*E04F 13/26* (2006.01)
*E04F 13/30* (2006.01)
*E04B 1/343* (2006.01)
*E04B 1/24* (2006.01)

(52) U.S. Cl.
CPC ..... *E04F 13/0803* (2013.01); *E04F 13/0814* (2013.01); *E04F 13/0891* (2013.01); *E04F 13/24* (2013.01); *E04F 13/30* (2013.01); *E04B 2001/2481* (2013.01)

(58) Field of Classification Search
USPC ..... 52/235, 36.1, 385, 762, 766, 768, 775, 52/483.1, 489.1
See application file for complete search history.

(56) References Cited

U.S. PATENT DOCUMENTS 5,042,216 A ‡ 8/1991 Stratmann ..... E04B 2/965 52/509
5,657,604 A * 8/1997 Malott ..... F16B 7/0473 52/655.1
5,899,035 A * 5/1999 Waalkes ..... E04B 2/7433 52/239
5,918,437 A ‡ 7/1999 Dobija ..... E04F 13/0826 52/287
5,974,753 A ‡ 11/1999 Hsu ..... E04F 13/0862 52/287
6,363,670 B1 ‡ 4/2002 Dewitt ..... E06B 9/02 292/13
6,546,684 B2 * 4/2003 Waalkes ..... E04B 2/7433 52/239
6,612,090 B1 * 9/2003 Corden ..... E04F 13/0803 52/235
6,718,717 B2 * 4/2004 Henderson ..... E04C 2/384 52/474
7,178,300 B2 ‡ 2/2007 Elsing ..... E04B 2/7448 52/476
8,833,017 B1 * 9/2014 Huang ..... E04F 13/144 52/235
8,966,842 B2 ‡ 3/2015 Hager ..... E05B 65/006 52/241
9,487,949 B2 ‡ 11/2016 Hager ..... E05B 65/006
10,329,773 B1 6/2019 Ferguson
2004/0045235 A1 * 3/2004 Ley ..... E04B 2/965 52/235
2008/0010922 A1 * 1/2008 Wagner ..... E04F 13/0812 52/235
2010/0319291 A1 ‡ 12/2010 Pervan ..... E04F 15/02 52/588.1
2017/0022707 A1 * 1/2017 Feldpausch ..... E04B 2/7455

FOREIGN PATENT DOCUMENTS

GB 1409713 A * 10/1975 ..... E04F 13/0814
JP 06257243 9/1994
JP 06257243 A * 9/1994
WO 2011161995 12/2011
WO WO-2011161995 A1 * 12/2011 ..... E04F 13/083

OTHER PUBLICATIONS

WPS Wall Panel Systems Inc., Installation Instructions, May 22, 2016 (http://wallpanelsystems.net/assets/RRS_Install_Instructions.pdf).‡
Marlite, Installation Instructions Surface Systems MAP (Mechanically Applied Panels), Nov. 17, 2016 (http://www.marlite.com/assets/TechDetails/Marlite%20Surface%20Systems%20MAP%20-%201nstallation%20Instructions% 2012-16.pdf).‡
Fry Reglet, Graph Modular Wall Cladding Product Brochure, Apr. 7, 2017 (date published on internet retrieved from Internet Wayback Machine) (http://fryreglet.com/downloadsproductresources/GRAPH_brochure_2016_WEB.pdf.‡
Marlite, Installation Instructions Surface Systems MAP (Mechanically Applied Panels), Nov. 17, 2016 (http://www.marlite.com/assets/TechDetails/Marlite%20Surface%20Systems%20MAP%20-%20Installation%20Instructions%2012-16.pdf).
Utility U.S. Appl. No. 16/029,067 "Method and Apparatus for a Wall Panel System" filed Jul. 6, 2018.

* cited by examiner
‡ imported from a related application

METHOD AND APPARATUS FOR A WALL PANEL SYSTEM

BACKGROUND

The present embodiments relate to a method and apparatus for a wall panel system.

Typical wall panel systems, include individual panels installed sequentially and tied into the previous panel and/or mounting hardware to securely lock the panels in position. Such systems are relatively complex and require both sequential installation and sequential removal to access, remove, repair, replace, upgrade, or provide general maintenance. For example, to access an interior wall panel several panels may need to be first removed and/or one or more panels (e.g. the interior wall panel) may need to be damaged before gaining access to the specific interior wall panel. As a result the one or more replacement panels for the damaged or panels sequentially removed may be disconnected from the original mounting hardware and require a different or modified mounting. Moreover, the wall panels at the end of the installation sequence may need to be attached to the wall in a different method or hardware making the installation/removal more difficult and costly. Thus, there is a need to provide a wall panel system to, but is not limited to, easily and conveniently install and/or remove a desired wall panel(s), gain access behind one or more panels, install/access wires, cable, or the like, change the décor of the panels/trim independent of mounting location of the panel

SUMMARY

In some embodiments of the invention, for example, a wall panel system may comprise a framework defined by a plurality of first rails intersecting a plurality of second rails to define a plurality of cells. In various embodiments, the wall panel system may include a plurality of panels having a front face and a rear face defined by an outer periphery. In some embodiments, at least one of the plurality of panels may be received within at least one of the plurality of cells. In addition, in various embodiments, the rear face of at least one panel of the plurality of panels may include a first retention device and a second retention device operably engaging at least one of the plurality of first rails and the plurality of second rails. In some embodiments, the first retention device may include a stowed position and a deployed position, wherein when in the deployed position the first retention device engages at least one of the plurality of first rails and the plurality of second rails.

In various embodiments, when in the stowed position the first retention device may be disengaged from at least one of the plurality of first rails and the plurality of second rails and at least one panel can separate from the framework. Moreover, in some embodiments, the first retention device and the second retention device may be different. In various embodiments, the second retention device may be in a fixed position relative to at least one panel. In various embodiments, the second retention device may be a clip. In some embodiments, the first retention device may extend along an axis between the stowed position and the deployed position. In addition, in some embodiments, the first retention device may be actuated by a magnet. In some embodiments, the framework may include one or more trim members.

In some embodiments, a wall panel system may comprise a framework defined by a plurality of first rails intersecting a plurality of second rails to define a plurality of cells. In various embodiments, the wall panel system may include a plurality of panels received within the plurality of cells. In addition, in some embodiments, the wall panel system may include at least one panel of the plurality of panels may include a plurality of retention devices. In various embodiments, at least one of the plurality of retention devices may engage at least one of the plurality of first rails and the plurality of second rails. In some embodiments, at least one of the retention devices may include a stowed position and a deployed position. In various embodiments, when in the deployed position at least one of the retention devices may engage at least one of the plurality of first rails and the plurality of second rails. In some embodiments, when in the stowed position at least one of the retention devices may be disengaged from at least one of the plurality of first rails and the plurality of second rails.

In various embodiments, at least one of the retention devices may be actuated by a magnet. In some embodiments, at least one of the plurality of retention devices may be in a fixed position relative to at least one panel. In addition, in various embodiments, at least one of the plurality of retention devices that is in the fixed position relative to at least one panel may be a clip. In some embodiments, at least one of the retention devices in the deployed position may create an interference fit with the framework locking at least one panel from separating from the framework. Moreover, in various embodiments, each of the plurality of first rails and the plurality of second rails may further comprise a channel, wherein at least one of the retention devices engages the channel when in the deployed position. In some embodiments, at least one of the plurality of retention devices may project from a rear face of the plurality of panels.

Other embodiments may include a wall panel system comprising a framework defining a plurality of cells secured to a wall. In some embodiments, each of the cells may include inwardly extending flanges defining a space from the wall. In various embodiments, the wall panel system may include a plurality of panels having a front face and a rear face defined by an outer periphery is received within the plurality of cells. In various embodiments, at least one panel of the plurality of panels may include a first retention device and/or a second retention device. In some embodiments, the first retention device and/or the second retention device may project from the rear surface thereof. In addition, in some embodiments, when at least one panel engages the framework, the first retention device includes a portion deployed into the space defined by the inwardly extending flanges and the second retention device may be positioned into the space defined by the inwardly extending flanges.

In addition, in various embodiments, when at least one panel may be disengaged from the framework, the portion of the first retention device is stowed from the space defined by the inwardly extending flanges. In some embodiments, the portion of the first retention device may be a pin axially deployed into the space defined by the inwardly extending flanges. Moreover, in various embodiments, the second retention device may be in a fixed position relative to at least one panel. In some embodiments, the inwardly extending flanges may extend about at least a portion of an inner periphery of each of the cells. In various embodiments, the inwardly extending flanges may include two parallel spaced flanges defining the space therebetween.

In some embodiments of the invention, for example, a method of installing a wall panel system may comprise the step of securing a framework to a wall to define a plurality of cells. In various embodiments, the method may include attaching a plurality of panels to the plurality of cells, wherein each of the panels of the plurality of panels includes a rear face and an opposite front face. Moreover, in some embodiments, at least one panel of the plurality of panels may include at least one first retention device on the rear face, wherein at least one first retention device includes a stowed position and a deployed position, wherein when in the deployed position at least one first retention device engages the framework. In various embodiments, the method may include locking at least one panel of the plurality of the panels to at least one cell of the plurality of cells when at least one first retention device may be in the deployed position.

In various embodiments, the method of locking may include actuating at least one first retention device to the deployed position from the stowed position. In some embodiments, the method of actuating may include using a magnet. In addition, in various embodiments, the method may include engaging a second retention device to the framework before the step of locking. In some embodiments, the method may include pivoting at least one panel towards the framework when the second retention device is engaged to the framework. In various embodiments, the step of pivoting at least one panel may include at least one first retention device being in the stowed position. Moreover, in some embodiments, the framework may include one or more trim members. In some embodiments, the method may include securing the one or more trim members to the wall panel system. In various embodiments, the method may include unlocking at least one panel of the plurality of the panels from at least one cell of the plurality of cells when at least one first retention device is in the stowed position.

In some embodiments, a method of installing a wall panel system may comprise the step of securing a framework to a wall to define a plurality of cells to receive a plurality of panels. In various embodiments, the method may include providing a first panel of the plurality of panels having a rear face and an opposing front face. Moreover, in various embodiments, the first panel may include a first retention device and a second retention device. In some embodiments, the first retention device and the second retention device may be positioned on the rear face of the first panel. In some embodiments, the first panel may be positionable between an aligned orientation with the framework and a misaligned orientation different from the aligned orientation. In addition, in some embodiments, the first retention device may include a stowed position and a deployed position, wherein when in the deployed position the first retention device engages the framework and when in the stowed position the first retention device is disengaged from the framework. In various embodiments, the method may include engaging the second retention device to the framework when in the misaligned orientation. In some embodiments, the method may include pivoting the first panel, when the first retention device is in the stowed position, from the misaligned orientation to the aligned orientation with the framework. In various embodiments, the method may include actuating the first retention device from the stowed position to the deployed position to engage the first retention device to the framework when the first panel is in the aligned orientation.

In various embodiments, the method may include actuating using a magnetic force. In some embodiments, the method may include attaching one or more trim members to the framework surrounding the plurality of panels. Moreover, in some embodiments, pivoting the first panel, when the first retention device is in the stowed position, from the aligned orientation with the framework to the misaligned orientation occurs when the adjacent plurality of panels have each one of the first retention device and the second retention device engaging the framework. In various embodiments, actuating the first retention device from the stowed position to the deployed position to engage the first retention device to the framework when the first panel is in the aligned orientation may include the step of extending a portion of the first retention device outwardly towards an outer periphery of the first panel.

Other embodiments may include a method of reconfiguring one or more wall panels within a framework comprising the step of providing a plurality of first wall panels engaging a framework attached to a wall structure, wherein each one of the first wall panels includes a retention device having a portion positionable between a deployed position engaging the framework and a stowed position disengaging the framework. IN some embodiments, the method may include separating one or more first wall panels from the framework when the portion of the retention device is in the stowed position.

In various embodiments, the method may include replacing the separated one or more first wall panels with one or more second wall panels. In some embodiments, the one or more second wall panels may be different from the one or more first wall panels. In addition, in some embodiments, the method may include separating one or more first trim members from the framework. In various embodiments, the method may include replacing the separated one or more first trim members with one or more second trim members. Moreover, in some embodiments, the one or more second trim members may be different from the one or more first trim members. In various embodiments, separating the one or more first wall panels may be completed out of successive order. In addition, in some embodiments, separating the one or more first wall panels may include actuating the portion of the retention device from the deployed position to the stowed position without removal of the adjacent plurality of first wall panels.

In some embodiments, the wall panel system may include a framework defined by a plurality of first rails and a plurality of second rails to define a plurality of cells. In various embodiments, the framework may include one or more projection clips attached to at least one of the plurality of first rails and the plurality of second rails, wherein the one or more projection clips includes an inwardly extending flange defining a space from a wall. In addition, in some embodiments, the wall panel system may include a plurality of panels having a front face and a rear face defined by an outer periphery, wherein at least one of the plurality of panels may be received within at least one of the plurality of cells. In various embodiments, the rear face of at least one panel of the plurality of panels may include a first retention device engaging at least one of the one or more projection clips. Moreover, in some embodiments, the first retention device may include a stowed position and a deployed position, wherein when in the deployed position the first retention device may include a portion deployed into the space defined by the inwardly extending flange of at least one of the one or more projection clips. In various embodiments, the first retention device may be a magnetically actuated pin (e.g. cylindrical) extending linearly between the stowed position and the deployed position.

In addition, in various embodiments, the rear face of at least one panel of the plurality of panels may include a second retention device engaging at least one of the one or more projection clips. In some embodiments, at least one rail of the plurality of first rails may include a longitudinal groove, wherein the longitudinal groove receives the one or more projection clips. In various embodiments, at least one rail of the plurality of second rails may include a first member and a second member defining at least one cell of the plurality of cells. Moreover, in some embodiments, the first member may engage at least one rail of the plurality of first rails and wherein the second member may engage another rail of the plurality of the first rails adjacent thereto. In various embodiments, the second member of at least one rail of the plurality of second rails may define a portion of two adjacent cells of the plurality of cells. In addition, in some embodiments, at least one rail of the plurality of second rails may be positioned at least one of perpendicular or angled relative to at least one rail of the plurality of first rails defining at least one cell of the plurality of cells. In various embodiments, at least one rail of the plurality of second rails may be angled relative to the at least one rail of the plurality of first rails defining the at least one cell of the plurality of cells, and not perpendicular thereto.

In various embodiments, a wall panel system may include a framework defining a plurality of cells. In various embodiments, each of the plurality of cells may include one or more projection clips engaging one or more rails, wherein the one or more projection clips may include an inwardly extending flange defining a space from a wall. In some embodiments, the wall panel system may include a plurality of panels having a front face and a rear face defined by an outer periphery, wherein at least one of the plurality of panels may be received within at least one of the plurality of cells. In addition, in various embodiments, at least one panel of the plurality of panels may include a retention device releasably engaging at least one clip of the one or more projection clips. In some embodiments, the retention device may include a magnetically actuated portion deployed into the space defined by the inwardly extending flange of at least one clip of the one or more projection clips.

In various embodiments, the wall panel system may include one or more second rails engaging the one or more rails to define at least one cell of a plurality of cells, wherein the one or more second rails may include a first member engaging one rail of the one or more rails and a second member engaging another rail of the one or more rails. In some embodiments, the one or more rails may include a longitudinal groove adapted to receive one or more projection clips and the first member, the second member, or both the first member and the second member. In various embodiments, each one of the first member and the second member may include an attachment mechanism to vary the framework defining at least one cell of the plurality of cells. In various embodiments, the attachment mechanism may pivot the first member within the longitudinal groove of one rail of the one or more rails between a plurality of pivot positions. Moreover, in some embodiments, the one or more second rails may be positioned in pivot positions other than perpendicular to the one or more rails. In various embodiments, the first member may be different from the second member.

In addition, in some embodiments, a framework defining one or more cells of a wall panel system, the framework may include a plurality of rails defining a plurality of cells configured to receive a plurality of wall panels. In various embodiments, at least one rail of the plurality of rails may include a longitudinal groove. In some embodiments, the framework may include one or more projection clips engaging a portion of the longitudinal groove of at least one rail of the plurality of rails. In various embodiments, the one or more projection clips may include an inwardly extending flange defining a space from a wall adapted to engage one or more retention devices of the plurality of wall panels.

In various embodiments, the framework may include at least one rail releasably secured to the longitudinal groove of two adjacent rails of the plurality of rails to define a portion of the periphery of at least one cell of the plurality of cells. In some embodiments, at least one rail may include a first member and a second member pivotably attached to the two adjacent rails, respectively. In various embodiments, the first member and second member may be different from each other. Moreover, in some embodiments, at least one rail may be configurable between a plurality of angles between the two adjacent rails. In various embodiments, the framework may include at least one second projecting clip engaging the one or more projecting clips to define a second space from the wall adapted to engage the one or more retention devices of the plurality of wall panels.

It should be appreciated that all combinations of the foregoing concepts and additional concepts described in greater detail herein are contemplated as being part of the subject matter disclosed herein. For example, all combinations of claimed subject matter appearing at the end of this disclosure are contemplated as being part of the subject matter disclosed herein. These and other advantages and features, which characterize the multiple embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
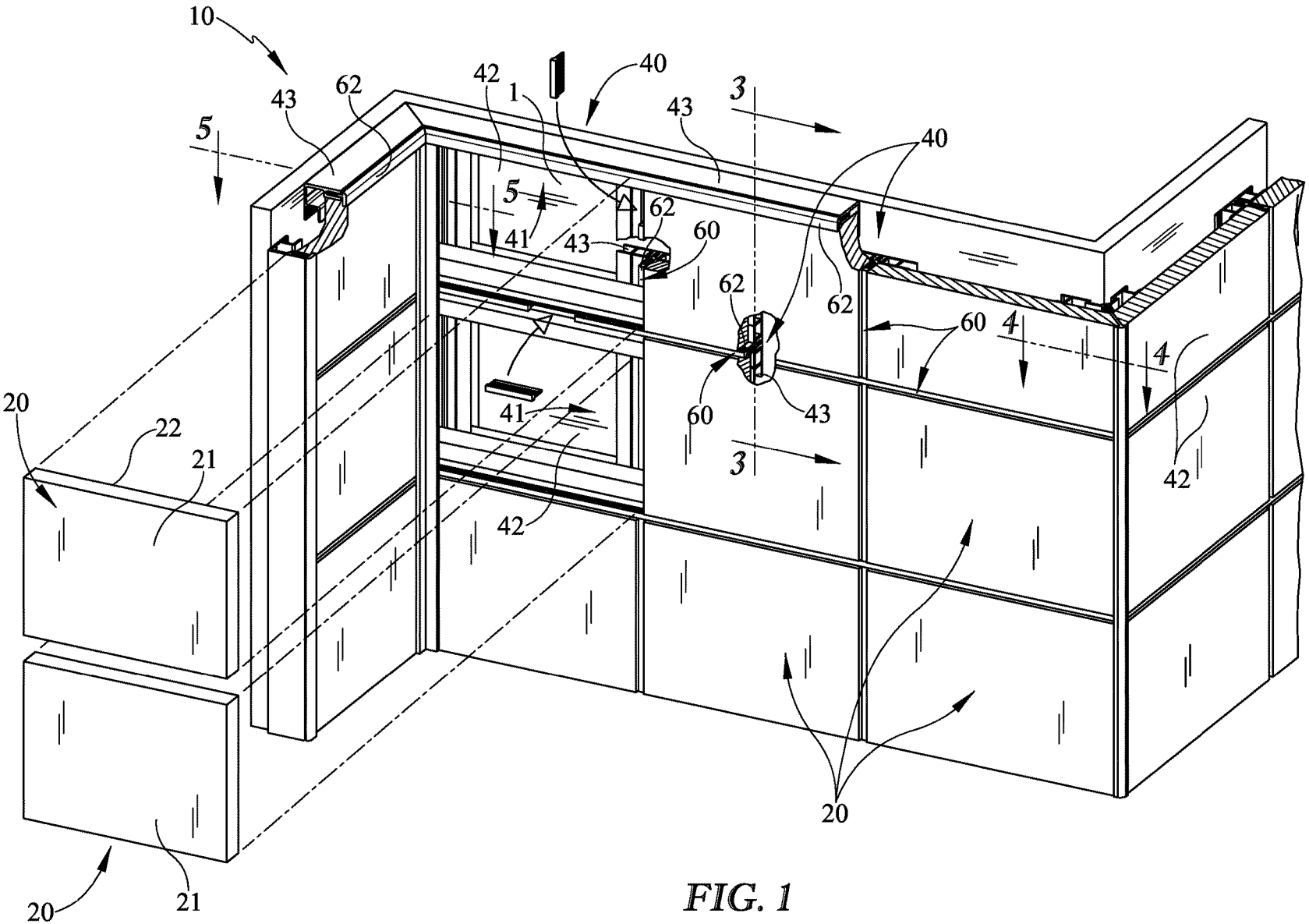
FIG. 1 is a perspective view of one embodiment of a wall panel system with wall panels and a portion of the trim exploded from an embodiment of the framework.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques for a wall panel system 10, such as the type that may be used to produce a finished wall surface such as, but is not limited to, homes, offices, hotels, and other facilities or in other similar applications to produce a wall covering. However, it will be appreciated that the herein-described apparatus and techniques may also be used in connection with other types of applications in some embodiments. For example, the herein-described apparatus and techniques may be used in residential, commercial, entertainment, artistic, advertisement, and/or agricultural applications in some embodiments. Moreover, the herein-described apparatus and techniques may be used in connection with a variety of wall or surface panel configurations and/or characteristics. One or more wall panels 20 may be a variety of surfaces, shapes, sizes, materials, colors, quantities, orientations, and construction. For example, the panel 20 may be wood grain, veneer, plastic, stone, metal, translucent, resins, backlit, solid, hollow, prefinished, unfinished, honeycomb, perforated, etc. The trim 60, if used, may be a variety of surfaces, shapes, sizes, materials, colors, quantities, orientations, and construction. Implementation of the herein-described apparatus and techniques within a variety of applications would be well within the abilities of one of ordinary skill in the art having the benefit of the instant disclosure, so the invention is not limited to the wall covering implementation discussed herein. For example, although the wall panels 20 may be parallel to the wall, object, structure, or mounting surface 1, the wall panels 20, trim 60, or other portions of a system may be different in appearance/construction and/or be in different planes and/or orientations relative to each other and the wall 1 or mounting surfaces. Although the wall panels 20 and/or trim 60, if used, are removable or releasably secured to the framework as shown in the one embodiment, it should be understood that in some applications one or more panels and/or trim may be fixed to the framework in combination with the releasably secured wall panels 20. Moreover, in some applications, the trim and/or panels may be fixed to embodiments of the framework 40.

Turning now to the drawings, wherein like numbers denote like parts throughout the several views, FIGS. 1-7 illustrate an example of one or more wall panel systems 10 in which the various technologies and techniques described herein may be implemented to cover a wall. The one or more wall panels 20 are assembled and secured to a framework 40 attached to a wall or structure 1 to provide a finished wall surface or covering. The underlying wall or structure 1 may be a variety of constructions, etc. The framework 40 utilizes a plurality of intersecting members or rails to define a plurality of cells 42. Each cell 42 may receive one or more panels 20. The wall panels 20 may be installed and/or removed from the framework 40 in a variety of ways or patterns (e.g. out of successive order). However, in some embodiments, the wall panels 20 may be installed or removed in a specific pattern or sequence.

Figure 2:
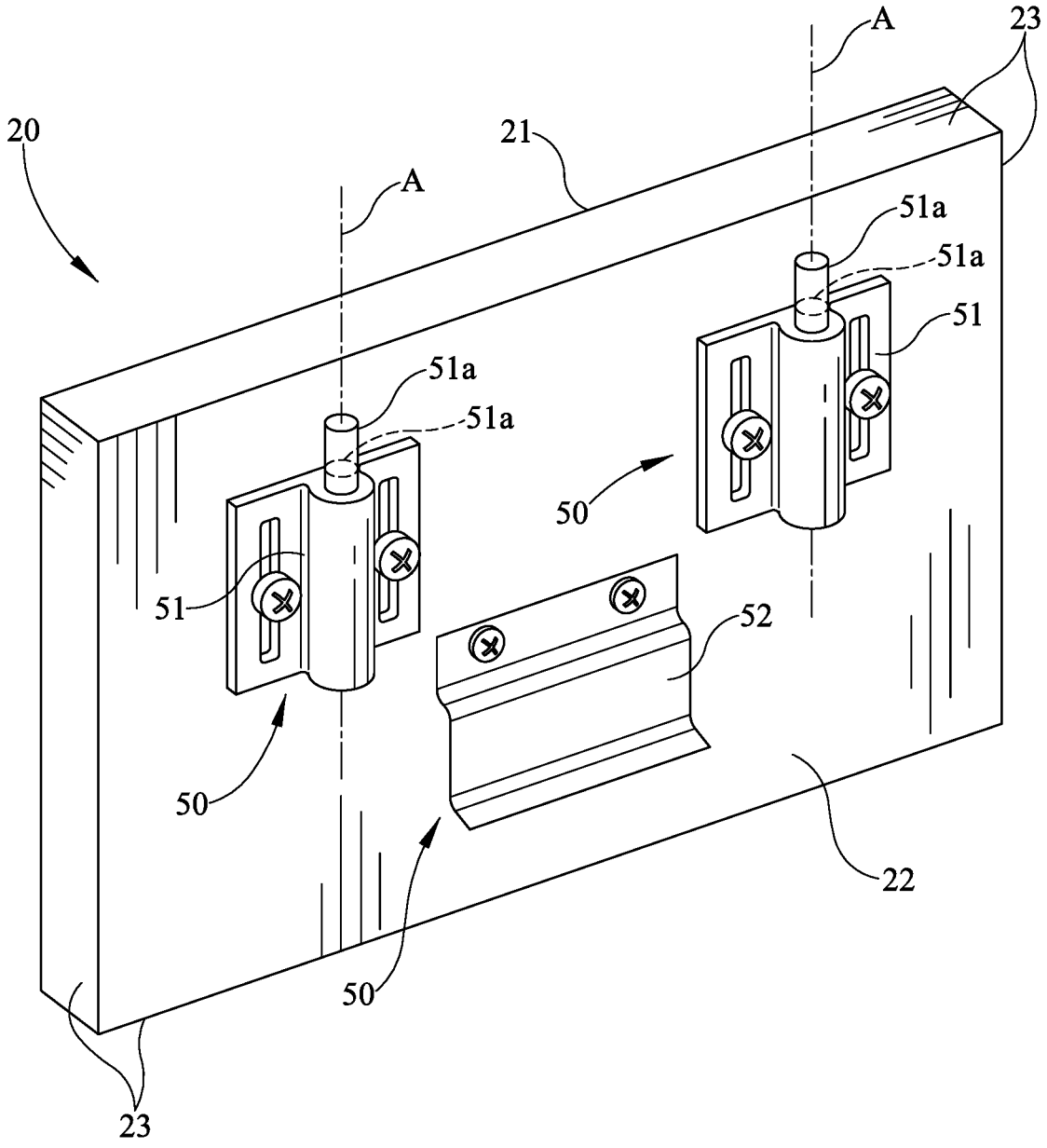
FIG. 2 is a rear perspective view of one embodiment of the wall panel of FIG. 1.
Figure 3:
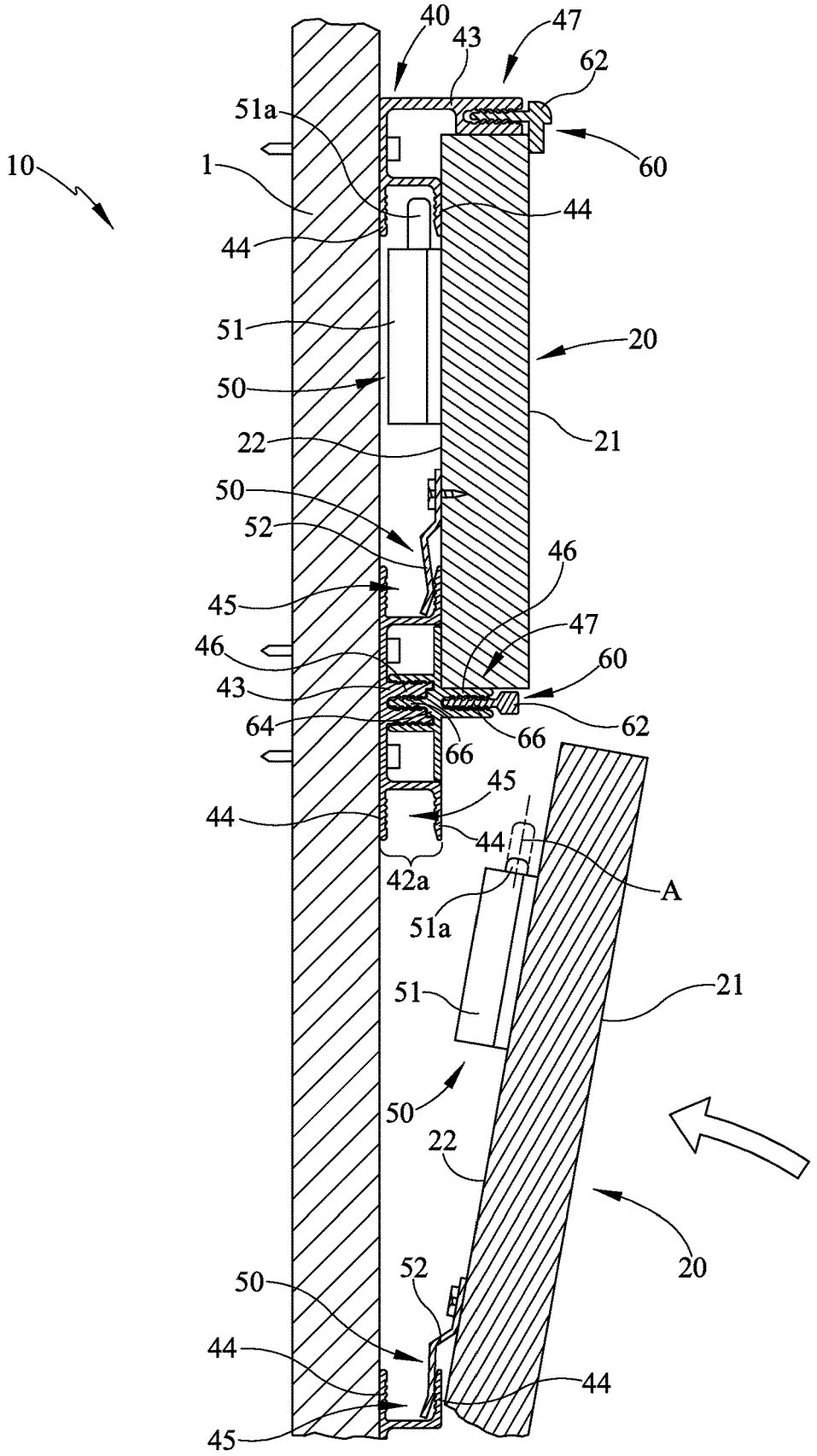
FIG. 3 is a sectional view taken along line 3-3 of FIG. 1 with one panel locked to the framework illustrating an aligned orientation with the first retention device in a deployed position engaging the framework, and another or lower wall panel having the second retention device engaging the framework while pivoting towards the framework illustrating an unaligned orientation with the first retention device in a stowed position.

The wall panel 20 or a portion thereof may be received by the framework 40 or cell 42. The wall panel 20 may be locked or engaged to the framework (e.g. one or more rails 43) when in an aligned or installed position/orientation. The wall panel 20 may be disengaged or unlocked from the framework when in the aligned position and/or misaligned position/orientation. The misaligned position is a position different from aligned position. Each of the wall panels 20 include one or more retention devices 50 to lock or secure the wall panel 20 to the framework 40 when in the aligned position. As shown in FIG. 2, at least one retention device 51 may be actuated from a stowed position, shown in broken lines, to a deployed position, shown in solid lines, to engage the framework 40 when in the aligned position. When in the deployed position, the retention device 51 engages the framework 40 and locks the wall panel 20 with the framework or rail 43. When in the stowed position, the retention device 51 is disengaged from the framework 40 or rail 43. Moreover, as shown in FIG. 3, when the retention device 51 in the stowed position, the wall panel 20 may be configured from the misalign position towards the aligned position. In addition, in the stowed position, the wall panel 20 may be unlocked and subsequently separated or disengaged from the framework or repositioned from the aligned position to the misaligned position.

Although the retention devices 50 may be similar to each other in some embodiments (e.g. retention devices 51), the one or more retention devices 50 may be different from each other as shown in the Figures. At least one retention device 52 may be fixed in some embodiments in combination with the actuated retention devices 51. For example, in the embodiments shown, the fixed retention device 52 may be fixed in positioned relative to the wall panel 20 (e.g. rear face). As shown in the Figures, the fixed retention device 52 may be a clip, attachment, fastener, etc. (e.g. rigid or flexible). If used, the clip may be secured or engaged to the framework 40 when the wall panel 20 is in the misaligned position and subsequently the wall panel is pivoted to the aligned position as shown in FIG. 3. Once aligned, the other or repositionable retention device 51 may be deployed from the stowed position to the deployed position to lock the wall panel 20 into the aligned position along with the fixed retention device.

Figure 2A:
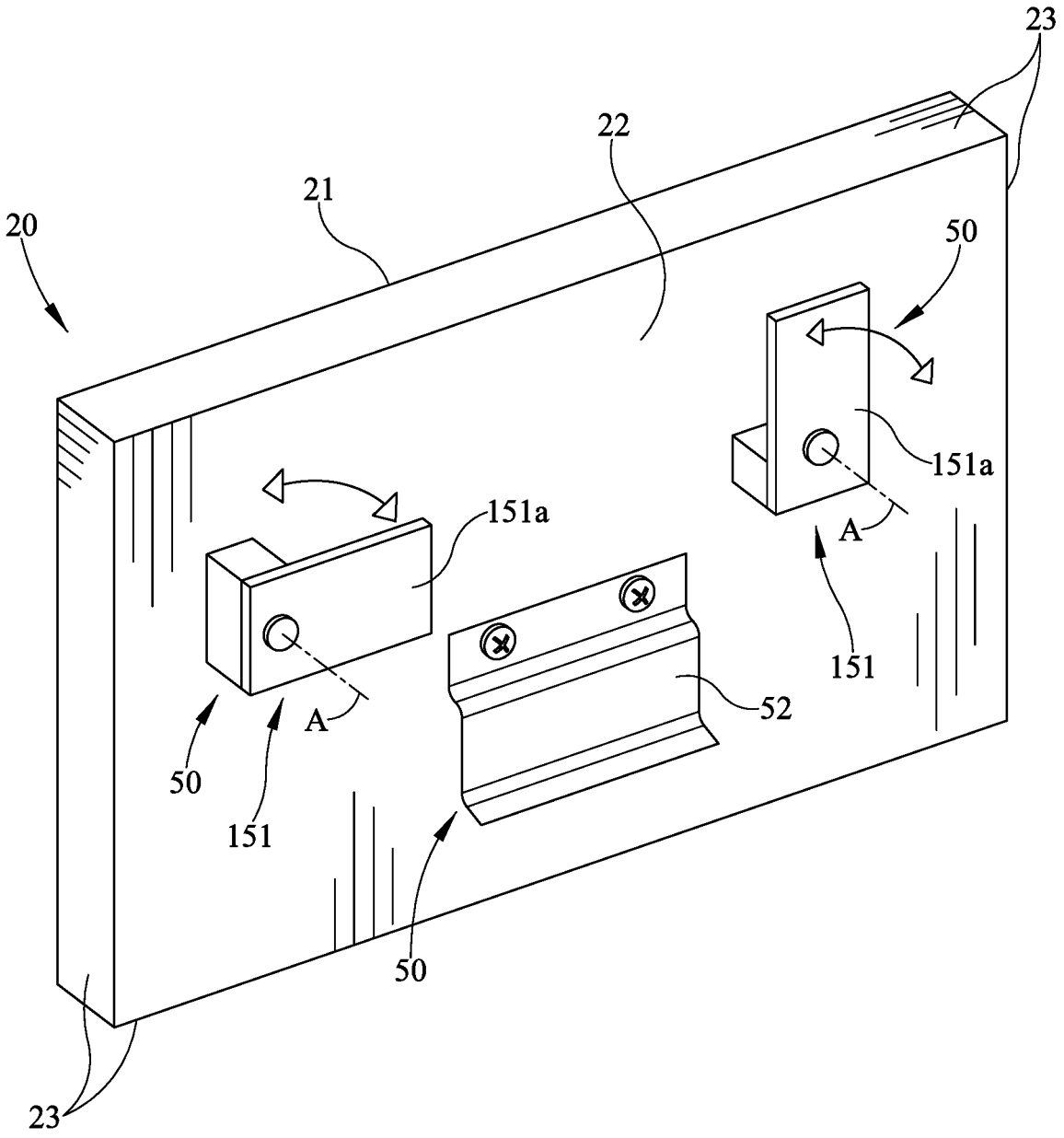
FIG. 2A is a rear perspective view of another embodiment of the wall panel.
Figure 2B:
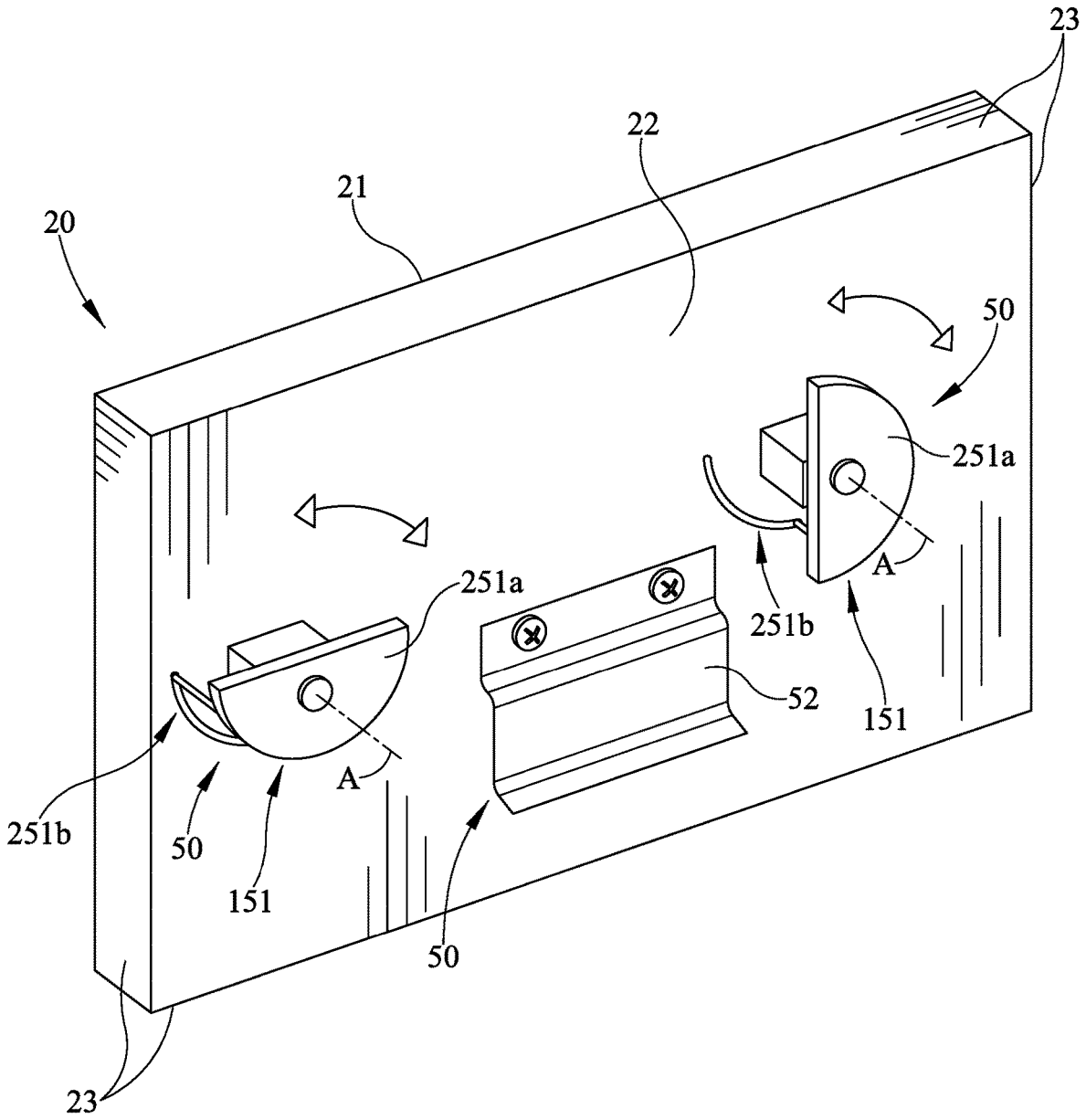
FIG. 2B is a rear perspective view of another embodiment of the wall panel.

A variety of actuators (not shown) may be used to reconfigure the movable retention device 51 or a portion thereof. In the embodiments shown, a magnet may be used to reposition the retention device 51 or fitting between the stowed and/or deployed positions. The magnetic actuator may be rotatable and drive a pin or portion 51*a* of the retention device into and out of engagement with the framework with a magnetic force. Once example of a magnet driven connecting fitting and rotatable magnetic drive is an INVIS Mx2 Magnet-driven Connecting Fitting. As shown in FIG. 3, the pin or structure 51*a* may axially travel along an axis A between the stowed position and the deployed position. In some embodiments, the magnet or other types of actuators may be used without the user visually seeing the position of the pin or movable portion 51*a* of the retention device 51 (e.g. when the panel is in the aligned position). Additional embodiments of the repositionable retention device 151 is shown in FIGS. 2A and 2B, one or more fasteners or clips 151*a*, 251*a* may rotate or pivot about an axis A in one or more directions into or out of engagement with the framework 40. Further shown in FIGS. 2A and 2B, the clip 151*a*, 251*a* on the left side of the rear face of the wall panel 20 is in the stowed position and the clip 151*a*, 251*a* on the right side of the rear face is shown in the deployed position. Moreover, a magnet may actuate the clips 151*a* and/or 251*a* in some embodiments between the one or more pivotable positions between the stowed and deployed positions. In some embodiments, the retention device 151 (e.g. 51*a*, 151*a*, 251*a*) may include a stop or catch engagement to locate or secure the position or orientation of the movable portion in its deployed and/or stowed positions. Although a pin and groove engagement 251*b* is shown in FIG. 2B to orient or secure the retention in one or more positions, the wall panel and/or retention devices may use a variety of other devices or engagements to secure, locate, stop, or guide the moveable portion. For example, a spring loaded ball and detent engagement may be used. It should be understood that the actuation and/or retention device 51 may be a variety of constructions, quantities, shapes, sizes, materials, and techniques. For example, the actuation may use a variety of tools, hand operated, or hands free, etc.

The one or more retention devices or portions thereof may create an interference fit engagement with the framework 40 (e.g. one or more portions or rails 43). One or more of the intersecting rails 43 may define one or more spaces 42*a* within each cell 42 receiving the deployed portion 51*a* of the retention device 51 and/or retention device 52. With the retention devices 50 held within the space 42*a*, the framework 40 and/or wall 1 prevents, impedes, or locks movement of the panel and/or portion of the retention device 50 from repositioning from the aligned position to another position or unaligned position. Alternatively stated, the interference fit locks or prevents separation of the wall panel 20 from the framework 40 when the retention device(s) 50 is in the deployed/engaged positions. When the moving portion 51*a* (e.g. pin) of the retention device 51 is in the stowed position or stowed away from the space 42*a*, the wall panel 20 may be disengaged from the framework 40 or moved into or out of the unaligned position (e.g. pivot, slide, translate, and/or rotate). Each cell 42 defined by one or more of the rails 43 may include the space 42*a* about an inner periphery 41 of the cell 42. The inner periphery 41 or portions thereof of the rectangular shaped cell 42 may include the space 42*a* defined by the one or more rails 43. In some embodiments, one or more inwardly projecting/extending flanges 44 within the cell 42 may define the space 42*a* to receive the retention device 50 (e.g. 51, 52) in the deployed/engaged position. The one or more flanges 44 may extend at least partially about the inner periphery 41 of one or more cells 42. In some embodiments, the flanges 44 may be substantially parallel to the wall or mounting surface 1. The space 42*a* may be defined between the flange 44 and the wall or mounting surface 1 in some embodiments. In the embodiments shown in the Figures, a pair of inwardly projecting flanges 44 may define a channel 45 or space 42*a* therebetween circumscribing the inner periphery 41 of the cell 42. The pair of flanges 44 may be spaced parallel to each other. In some embodiments, the channel 45 may be a variety of distances from the wall or mounting surface 1 and defined by one or more portions of the framework or mounting surface. The space 42*a*, channel 45, and/or flange(s) 44 may be defined by a variety of constructions, shapes, sizes, and quantities of the framework 40, rails 43, and/or mounting surface 1 and still engage/disengage from the one or more retention devices 50.

Figure 4:
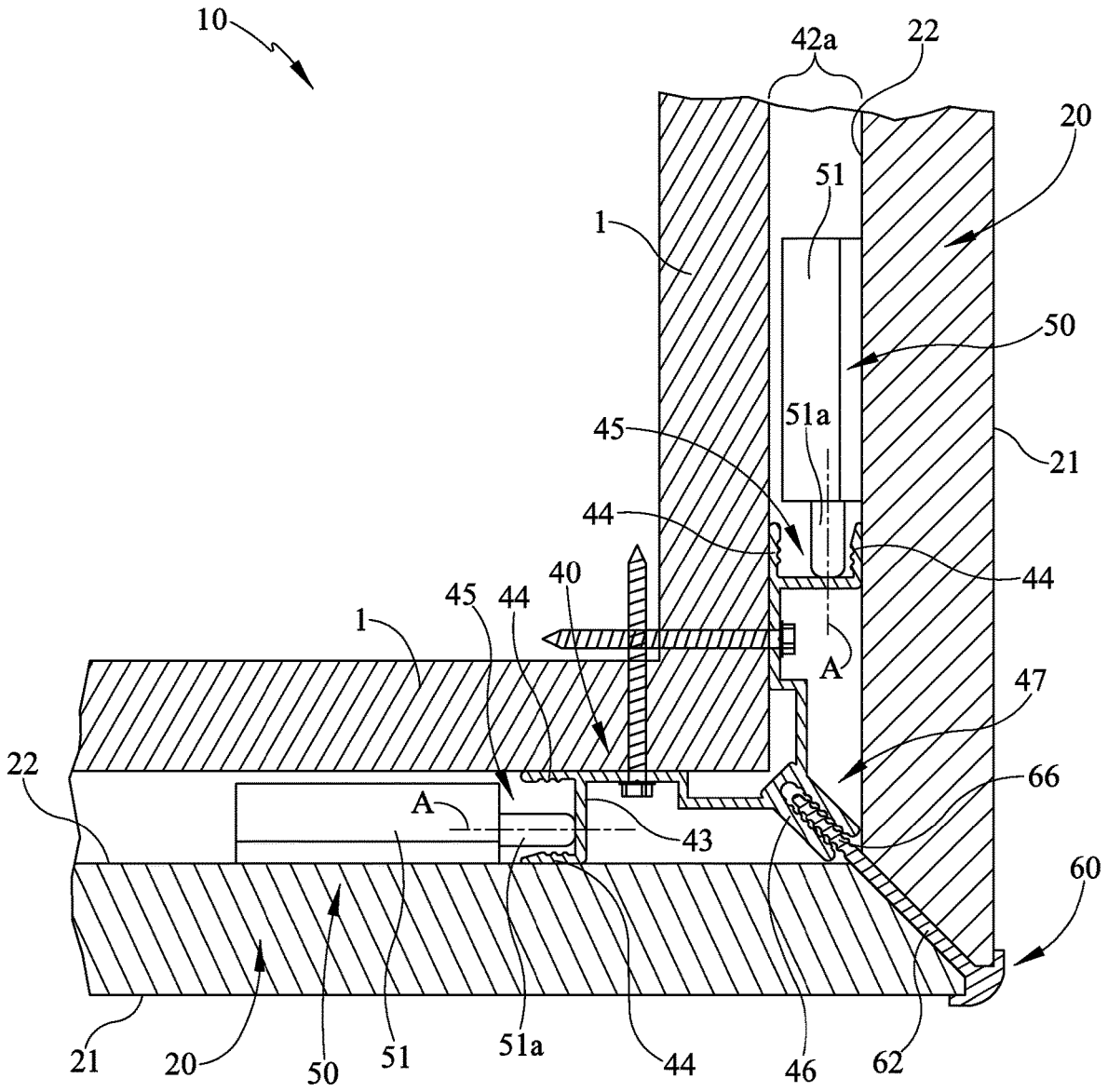
FIG. 4 is a sectional view taken along line 4-4 of FIG. 1 illustrating an outside corner.
Figure 5:
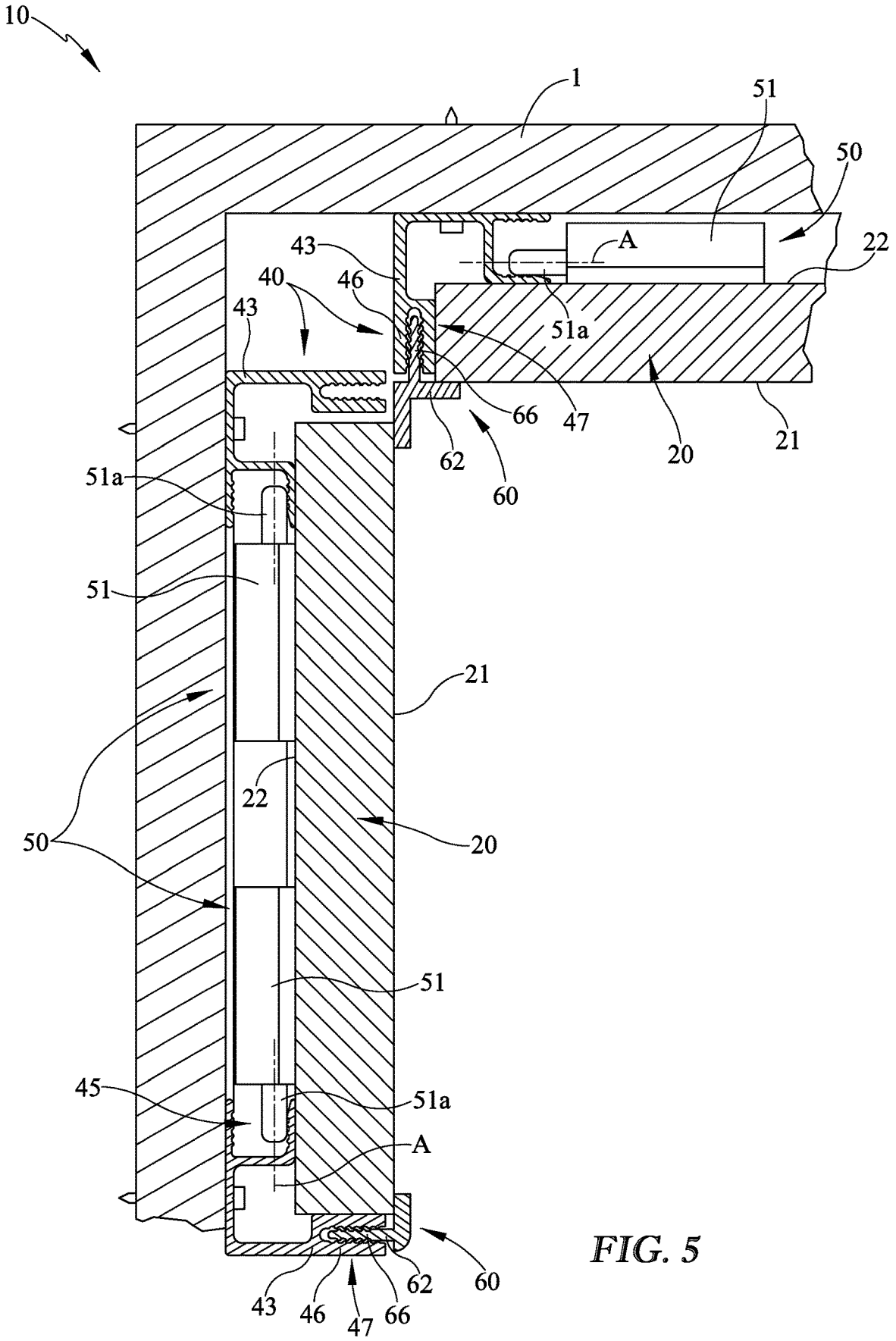
FIG. 5 is a sectional view taken along line 5-5 of FIG. 1 illustrating an inside corner.

The wall panel 20 may be a variety of constructions, sizes, shapes, materials, quantities, and orientations and still be within the scope of the invention. The wall panel 20 may have a front face or surface 21 and an opposing rear face or surface 22 defined by an outer periphery 23. The wall panels 20 may be at least partially received within the cell 42 defined by the framework 40. As shown in the embodiment in the Figures, the retention devices 50 may project from the rear face 22 of the wall panel 20. It should be understood that the retention devices (e.g. 51 and/or 52) may be located or project from a variety of positions from the wall panel 20 including, but is not limited to, the front face, rear face, and/or outer periphery. The retention devices 50 may deploy or be in a position within in the outer periphery 23 as shown allowing the fasteners to be not visible during/after assembly. This may allow for embodiments with no visible connectors. Alternatively, the retention devices or portions thereof may be exposed outside the outer periphery of the panel 20 and/or portion of the retention device 50 may be deployed or extend beyond the outer periphery 23 or outer extent in some embodiments. As shown in the embodiments in FIG. 2, the first retention device 51 and second retention device 52 project form the rear face 22 of the wall panel 20. Moreover, actuating the retention device 51 may include extending the portion 51*a* of the device towards an outer periphery of the wall panel or inner periphery of the cell. The second or fixed retention device 52 opens up into or extends in a direction opposite to the direction of deployment of the first retention member 51. Although the retention devices 50 are shown in Figures as engaging opposing rails 43 or framework in opposite directions, it should be understood that the one or more retention devices 50 may extend or be orientated in a variety of directions and still engage one or more rails 43 (e.g. flanges, channels, inner periphery, cell, framework, or spaces) to create the interference fit. For example, as shown in FIGS. 4 and 5, the portion 51*a* of the retention device 51 is deployed/stowed in a substantially horizontal direction to releasably engage the vertically extending rails 43 as compared to the vertical direction of FIGS. 2 and 3 to releasably engage the horizontally extending rails 43. As shown in FIG. 5, the embodiment of one wall panel includes only retention devices 51, with a fixed retention device to deploy in opposite directions (e.g. horizontal).

The one or more portions 51*a* of the retention devices 51 and/or retention device 52 may be engaged and disengaged without the user visually identifying the position of the portion of the retention device relative to the framework and/or panel when in at least the aligned position. Alternatively stated, there may be no visible connectors. The portion 51*a* (e.g. pin) of the first retention device 51 may be engaged or disengaged from the framework 40 when the wall panel 20 is in the aligned position without the user visually identifying the position of the retention device. The user may hear an audible and/or feel or lack thereof of the interference fit to determine the position of the one or more retention devices 50 or portions thereof. Other methods may include, but is not limited to, a visual identifier of the locked/unlocked position may be used in some embodiments. The panels may be installed and removed irrespective of the relative status of the adjacent panels or order of placement.

Figure 6:
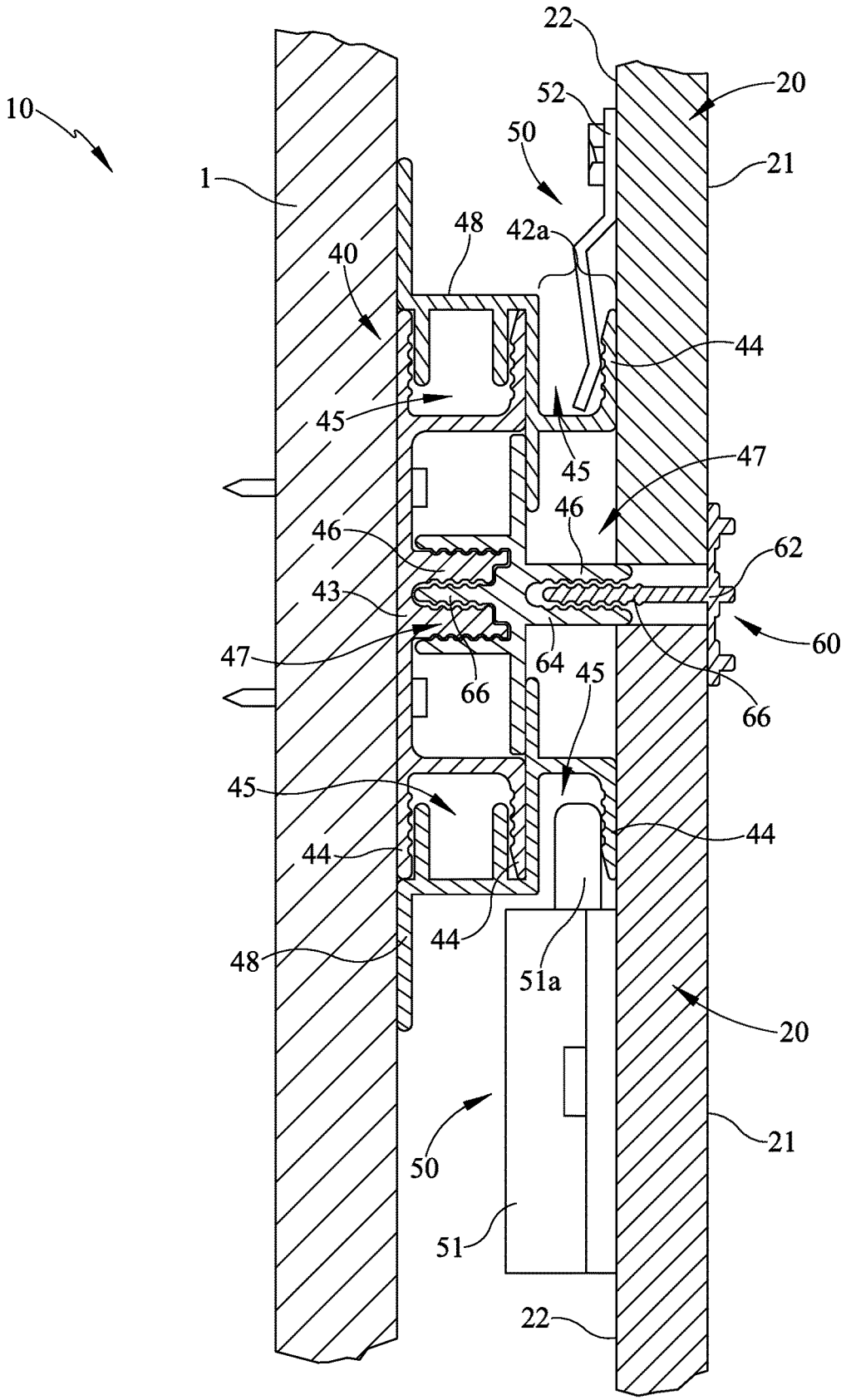
FIG. 6 is a sectional view taken along line 3-3 of FIG. 1 illustrating another embodiment of the framework with a projection clip, if used.
Figure 7:
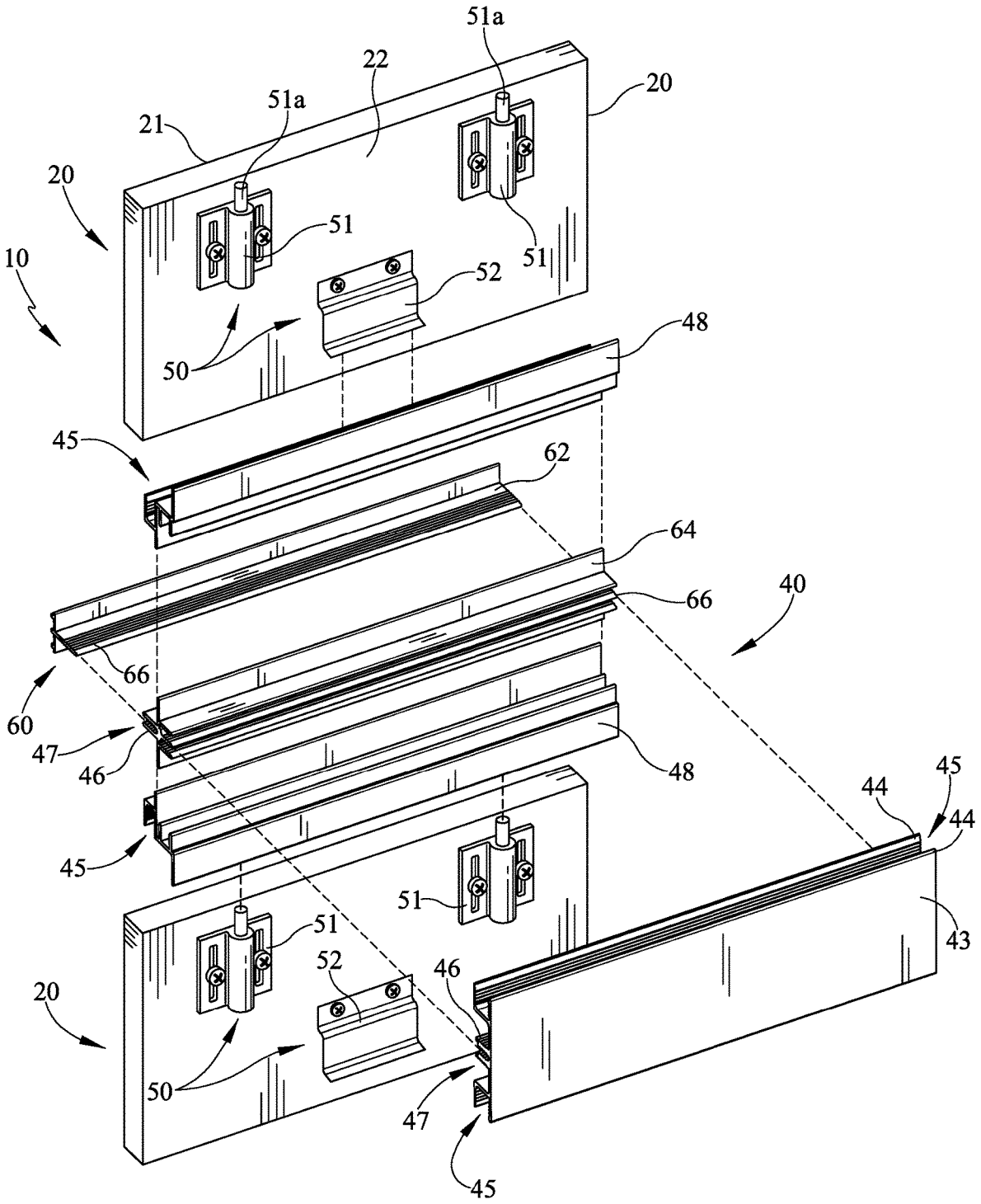
FIG. 7 is an exploded view of the wall panel system of FIG. 6 with the projection clip, if used.

The framework 40 may include a variety of one or more trim members or trim 60, if used, in some embodiments. In some embodiments, one or more portions of the framework 40 or rails 43 may not include the trim member 60. In other embodiments, a plurality of trim members 60 may be used in one or more rails 43 of the framework 40 that are different from each other. The framework 40 or rails 43 may include a trim engaging mechanism 47. As shown, the trim engaging mechanism 47 of the framework 40 is a receiving structure or female connection 46. As such the trim 60 may include a male connection or projection structure 66. It should be understood that the trim engaging mechanism 47 of the rail/framework and trim connections therebetween may be a variety of constructions, shapes, sizes, quantities, and still be within the scope of the invention. For example, in some embodiments the male/female connection may be reversed. It should also be understood that the trim members 60 may be of a variety of shapes, sizes, materials, quantities, and construction. For example, the outside and inside corner trim as shown in FIGS. 5 and 6, respectively, are different from the trim between wall panels positioned interior of the outer periphery of a wall section or planar section. The trim 60 may extend over a portion of the front face 21 of the wall panel 20 in some embodiments as shown in FIG. 6. As such, one or more trim members may be removed before a panel may be removed. In other embodiments, the one or more trim members may be installed before the wall panel is assembled to the framework. As shown in FIG. 3, one or more trim members 60 (e.g. between panels) may not extend over the front face 21 of one or more panels 20. Moreover, one or more trim members 60 may need to be installed after or before the wall panel is inserted into the cell and/or into the aligned position. In some embodiments, trim may not be used in one or more portions of the wall panel system. In other embodiments, the trim may project short of or beyond the front face 21 extent of the wall panel. As shown in the Figures, the trim 60 may be of a two or more piece construction extending from the rail 43. For example, in one embodiment shown in FIGS. 3 and 6, the trim 60 includes a reveal trim piece 62 and a trim coupling 64 between the reveal trim piece 62 and the rail 43. The trim coupling may have corresponding trim engagement mechanism 47 (e.g. male and/or female connections) to engage both the reveal trim piece and the rail 43. In some embodiments as shown in FIGS. 4 and 5, a reveal trim piece 62 may be secured directly to the rail 43.

In some implementations, the framework 40 may include an extension or projection clip 48 between the rail 43 and wall panel 20. The projection clip 48 may space the wall panel 20, trim 60, and/or other portions of the system further from the wall or mounting surfaces 1 and/or rail 43. Different panels, trim, or other system structure may be used with the projection clip 48. The projection clip 48 may define at least a portion of the space 42*a*, flange 44, and/or channel 45 for releasable engagement with the one or more retention devices 50 (e.g. 51 and/or 52). The projection clip 48 may extend from the one or more rails 43 to define the inner periphery 41 of the cell 42.

The framework and portions thereof (e.g. trim, projection clips, etc.) may be a variety of colors, finishes, materials, lengths, shapes, sizes, material, and constructions. For example, the framework may be extruded aluminum (e.g. concealed, exposed, etc.).

In some implementations as shown in FIGS. 8-17, the framework 140 may include one or more cells 42 defined by the plurality of rails 143 using one or more extension or projecting clips 148 to engage at least one retention device 50 (e.g. 51 and/or 52) of the wall panel system 110. The projection clip 148 may engage the one or more rails 143 for engagement with one or more of the retention devices 50. The projection clips 148 may extend for a portion of the rail 143 or remaining framework 140. One or more retention devices 51 and/or 52 may engage one or more of the projection clips 148. The projection clip 148 may engage the corresponding rail 143 (e.g. 143*a* and/or 143*b*) and may be positioned or fixedly secured with one or more fasteners 9. The fasteners 9 (e.g. screw), if used, may secure the projection clip 148 to the rail 143 and/or wall 1. The fastener 9, in some embodiments, may secure the rail 143 to the wall 1. In the one embodiment shown in FIGS. 8 and 11, the clip 148 may engage at least one rail or the first rail 143*a*. The projection clip 148 may include one or more inwardly extending flanges 144 to define the one or more spaces 142*a* from the wall or rail to receive one or more retention devices 50 (e.g. 51 and/or 52, etc.) or portions thereof.

Figure 16:
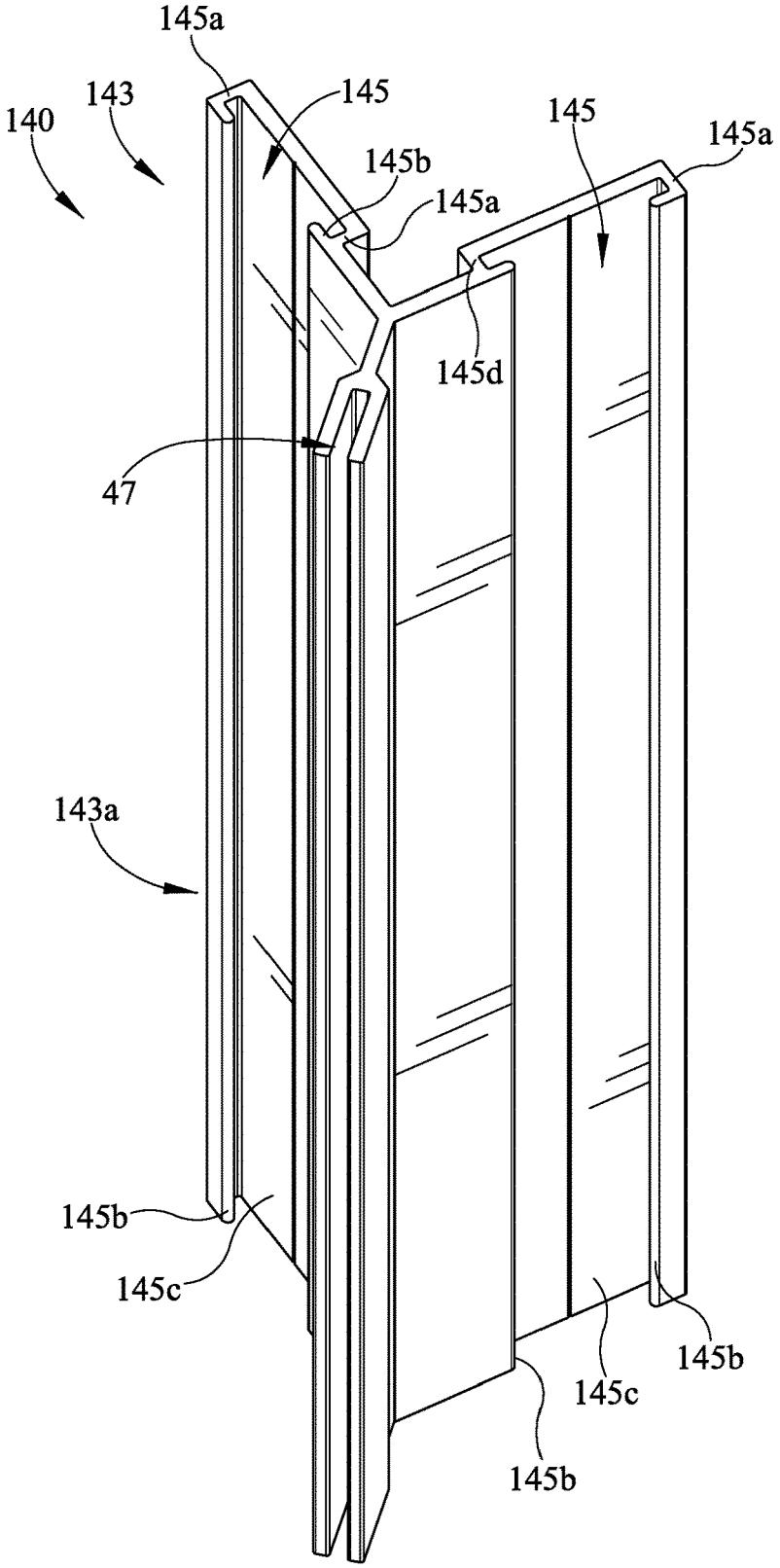
FIG. 16 is a perspective view of an embodiment of an outside corner rail of the framework.

In the one embodiment shown in FIGS. 8-14B and 16, one or more rails 143 (e.g. horizontal, vertical, angled, arcuate, etc.) may include one or more longitudinal channels or grooves 145 extending for at least a portion of the length of the rail 143 to receive the one or more projection clips 148. In some embodiments, the side of the rail 143 opposite the wall 1 may include the one or more longitudinal grooves 145. Although the groove 145 extends the length of the rail, one or more grooves may extend for a portion of the length of the rail 143 and/or cell periphery 41. For example, two or more grooves may be parallel to each other and/or spaced end to end along the length of the rail. As shown in FIG. 16, the rail 143 includes two grooves 145 (e.g. parallel to each other) for an outside corner rail. Although not shown, an inside corner rail with one or more grooves is contemplated in some embodiments. The projecting clip 148 and rail 143 (e.g. groove 145) may include an interference fit. One or more sides 145*a* of groove 145 may include an overhang portion or lip 145*b* extending over a bottom wall 145*c* as shown in the one embodiment. The overhang 145*b* may interfere with the projection clip 148 or portions thereof such that the projection clip 148 may be releasably retained or fixed. The projection clip 148 may include one or more protrusions or flanges 148*a* that interfere with the rail overhang 145*b*. This retention or interference fit may allow the clip 148 to be placed/snapped into a rail 143 and/or slide for a length within the groove or overhang portion 145*b* to another longitudinal position of the groove for placement or alignment with the one or more retention devices 50. Further, the retention or interference fit between the projection clip 148 and rail/groove 143, 145 may allow the user hands-free use before securing the projection clip into position with the fastener 9, if used. In the one embodiment shown, the cell 42 or framework 140 may include the projection clips 148 on two adjacent horizontally positioned rails 143 (e.g. 143*a*). The one or more inwardly extending flanges 144, defining the space 142*a*, projects into the one or more cells 42 and may receive a portion of the first and/or second retention devices 51, 52 from one or more retention devices 50.

In an implementation shown in FIGS. 8-16, another embodiment of the rail 143 may be used to define one or more portions of one or more cells 42 or framework 40, 140. The rail 143 may vary the configuration of the framework or cell to accommodate a variety of wall panels with varying shapes, sizes, quantities, and/or constructions. For example, one embodiment of the rail 143 may be a two or more piece/member construction. For example, as shown in the one embodiment, a second rail 143*b* may include at least a first member 243*b*1 and a second member 243*b*2 for one or more cells. The plurality of members (e.g. first and second member 243*b*1, 243*b*2) may define at least one side of the cell or one or more adjacent cells 42. The second rail 143*b* may releasably secure or fix to one or more adjacent rails or rails 143 (e.g. the longitudinal grooves 145 of the first rails 143*a*) to define a portion of the one or more cells or peripheries of the cells. For example, the first member 243*b*1 may engage one rail 143 or first rail 143*a* and the second member 243*b*2 may engage another rail 143 or an adjacent first rail 143*a*. The one or more members or portions of the rail may engage the longitudinal groove 145 of the one or more rails to form the second rail or framework. Moreover, one of the members of the rail 143 (e.g. second rail 143*b*) may define two or more adjacent cells by projecting away from a single rail in two or more directions. Although the first member and second member may be used to define at least one cell, it should be understood that two or more second members may be used together to form a second rail and/or alternatively two or more first members may form a second rail of a cell. As shown in the one embodiment, the first member and the second member are different from each other. Alternatively, the members of a portion of a cell may be the same to define the second rail or portions thereof. For example, two or more first members 243*b*1 may be used together to form a rail 143 or 143*b*. Moreover, for example, two or more second members 243*b*2 may be used together to form the rail 143 or 143*b*. Although not shown, the second rail 143*b* may include one or more grooves 145 for one more clips 148. The first and second member may be spaced from each other as shown in the same plane, or may interconnect in some embodiments and/or be in different intersecting planes. The one or more members of the one or more rails/framework may be a variety of constructions, quantities, shapes, and sizes and still be within the scope of the invention.

Figure 8:
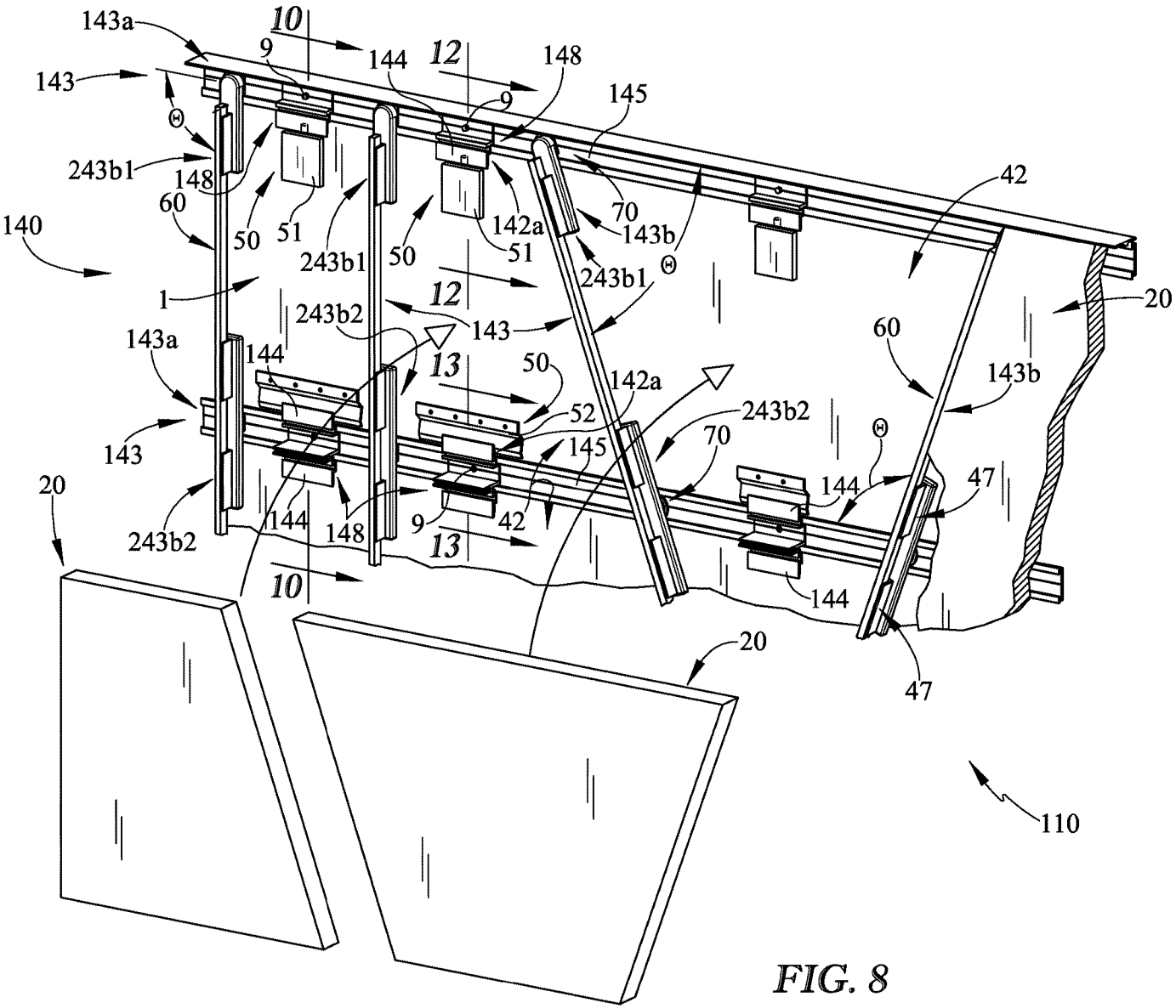
FIG. 8 is a perspective view of another embodiment of a wall panel system with wall panels exploded from the retention devices and an embodiment of a framework.
Figure 9:
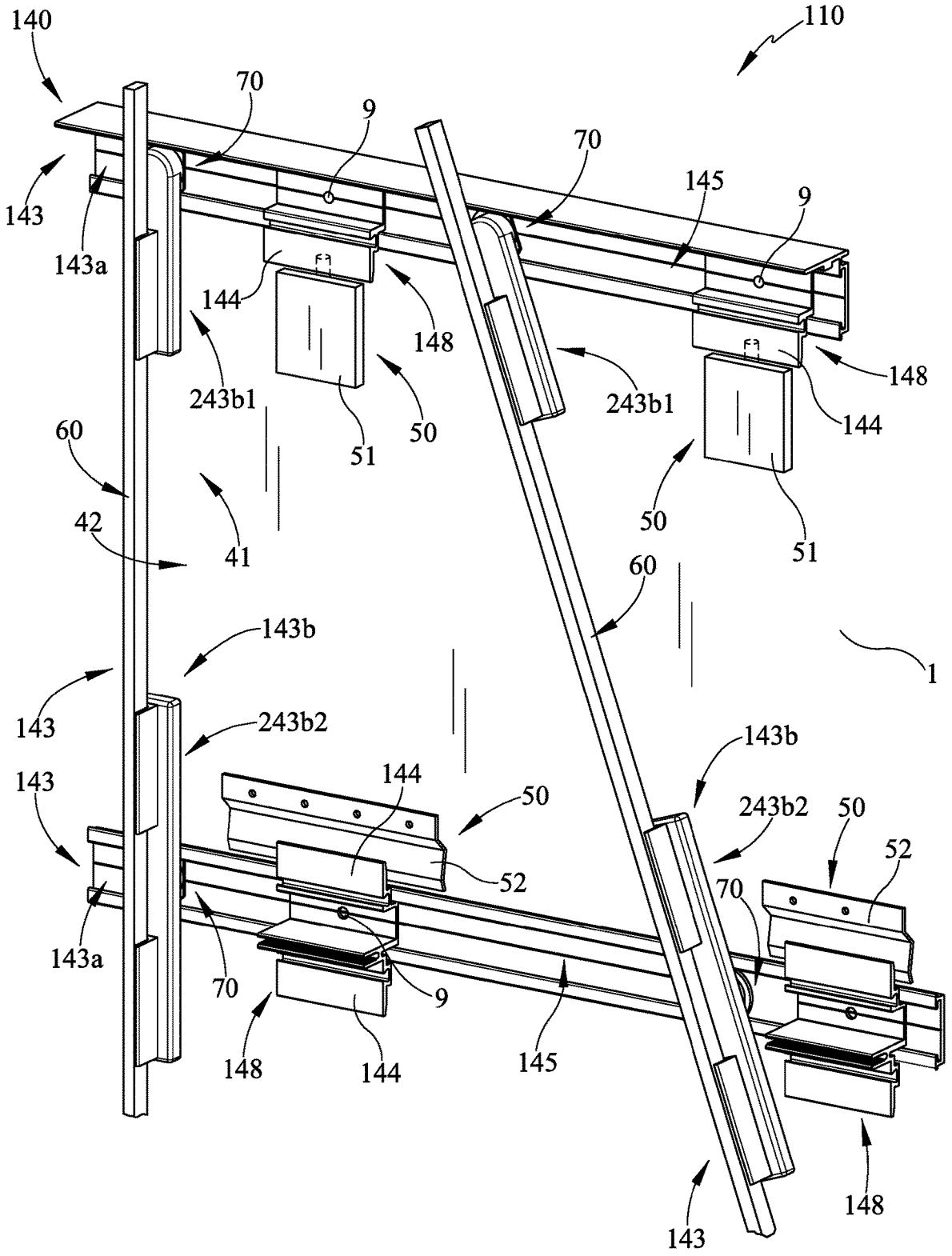
FIG. 9 is a perspective view of the framework of FIG. 8 illustrating the varying orientations of the rails for the framework along with the wall panel retention devices engaged and the remaining portion of the wall panels removed.
Figure 10:
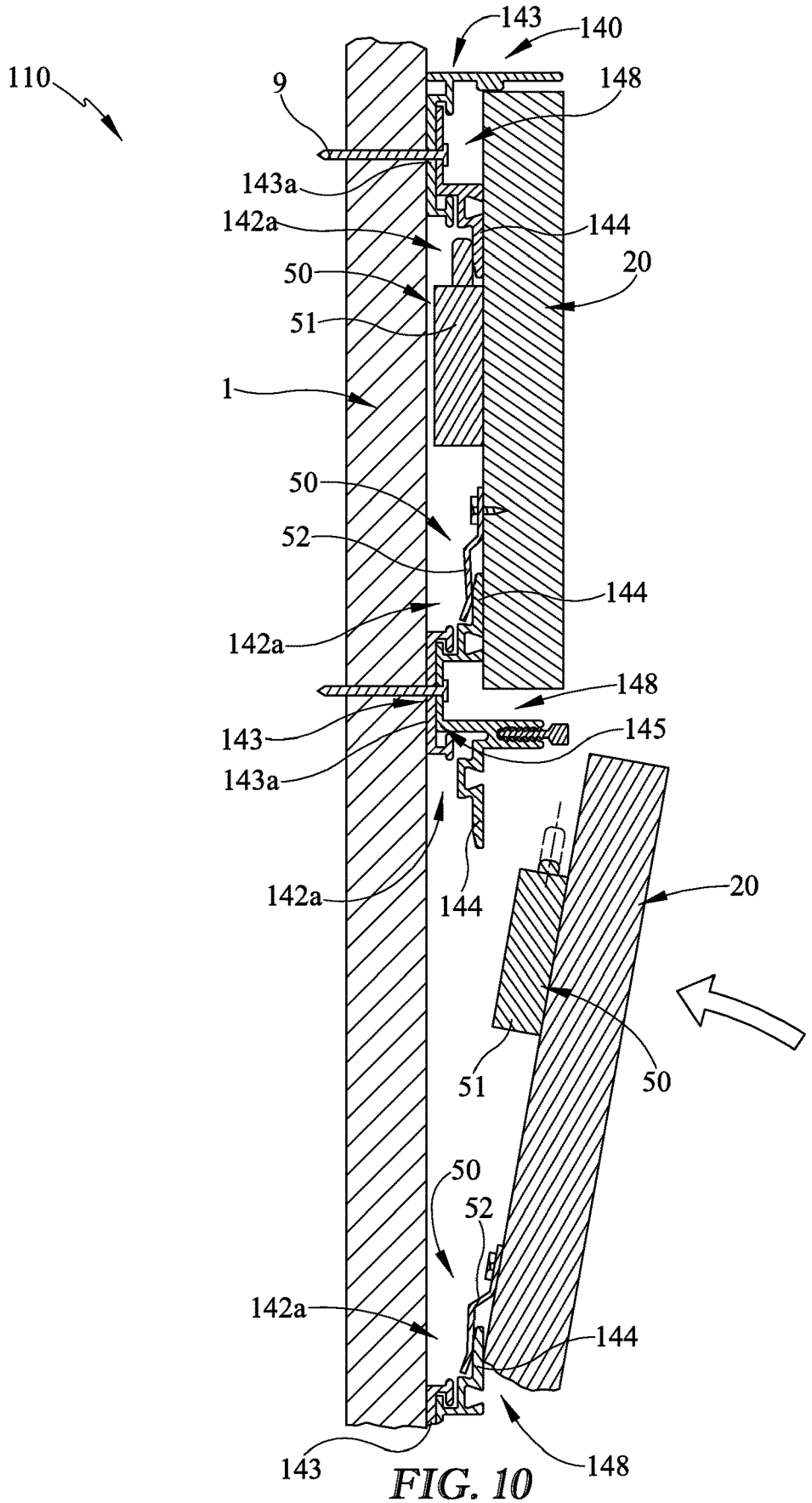
FIG. 10 is a sectional view taken along line 10-10 of FIG. 8 with one panel locked to the framework illustrating an aligned orientation with the first retention device in a deployed position engaging the framework or projecting clip and the second retention device engaging the framework or another projecting clip, and another or lower wall panel having the second retention device engaging the framework or projecting clip while pivoting towards the framework illustrating an unaligned orientation with the first retention device in a stowed position.

In some embodiments, as shown in FIGS. 8, 9, 11, and 14A-15 one or more rails (e.g. second rails) may be configurable between a plurality of angles θ between one or more adjacent rails (e.g. first rails). The ability to configure the members or rails between the plurality of positions or pivot positions may allow the user to vary the shapes, quantities, and/or sizes of the panels, cells, or framework for a variety of wall panel applications. The second rail(s) (e.g. first and second members, etc.) may combine to define a perpendicular intersecting rail between two adjacent or parallel rails 143. Moreover, in some panel arrangements, the second rail 143*b* may be angled or transverse to the horizontal or first rail. The pivot position or angle θ may be a variety of angles other than perpendicular in some embodiments. For example, as shown in FIG. 9, the wall panel system 110 or at least one application may include second rails 143*b* that have varying angles or orientations, such as perpendicular and/or non-perpendicular angles for at least one rail or second rail. As illustrated, the second rail may be angled in positions other than perpendicular (e.g. ninety degrees) to the one or more rails (e.g. first rail). The second rail (e.g. first and/or second member) may be positioned in a range of angles θ between 0 and 180 degrees. The members (e.g. first member and the second member) may be angled relative to each other (e.g. nonlinear) or positioned in the same plane as shown in some embodiments.

The members or portions of the second rail or rails may combine and space panels from each other and/or hold one or more trim members between panels in some embodiments. As shown in FIGS. 8 and 9, the second rail or rails may be, but is not limited to, vertical and/or angled orientations. In various embodiments, not shown, the second rail may be horizontal or another orientation in some embodiments. It should be understood that the rails 143 may be used in wall panel systems using rails 43 in various embodiments.

Figure 11:
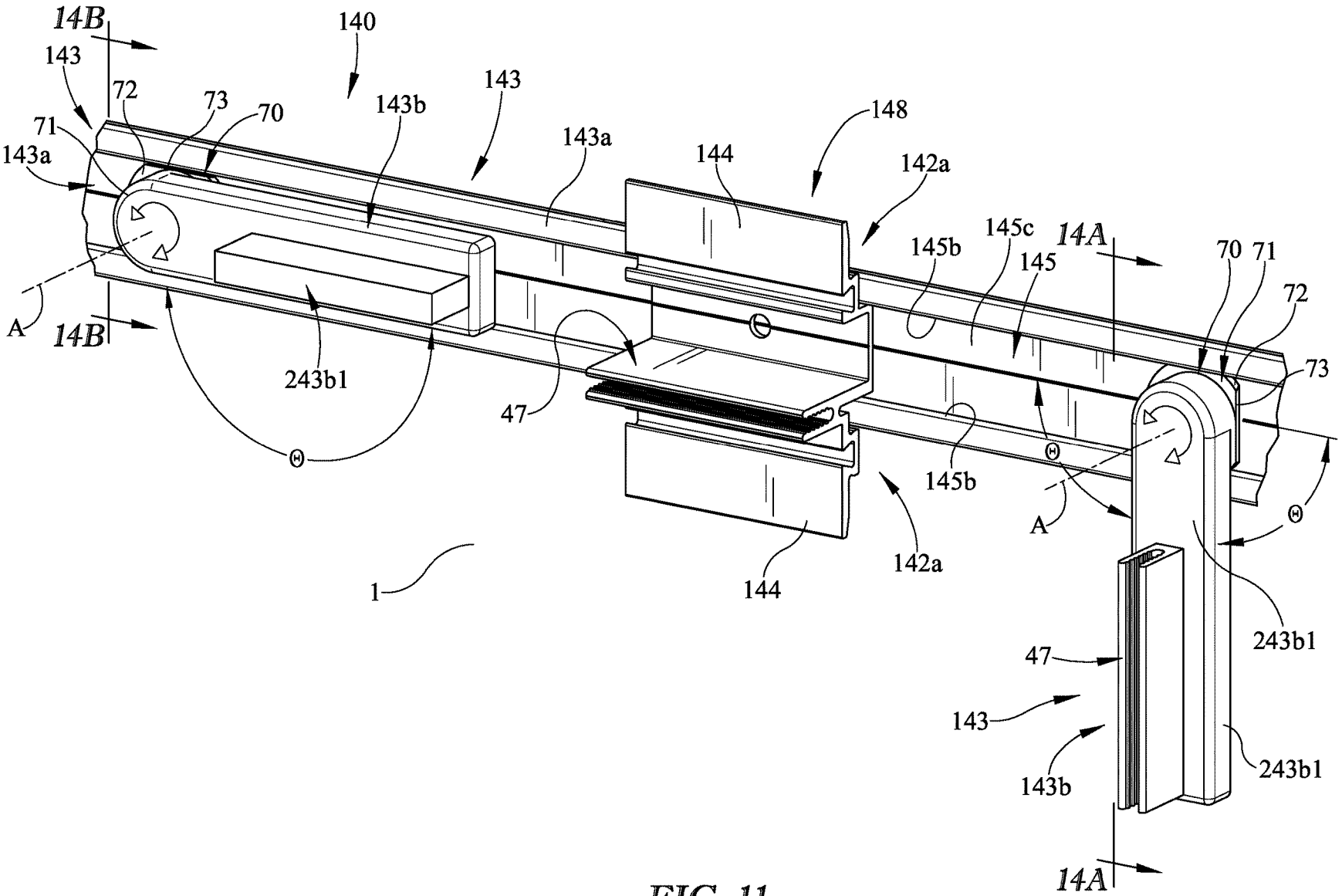
FIG. 11 is an enlarged perspective view of the framework of FIG. 8 illustrating a projecting clip engaging the groove of the rail and the varying pivoting orientations of the rails or rail members for the framework engaging the groove of the rail.
Figure 14A:
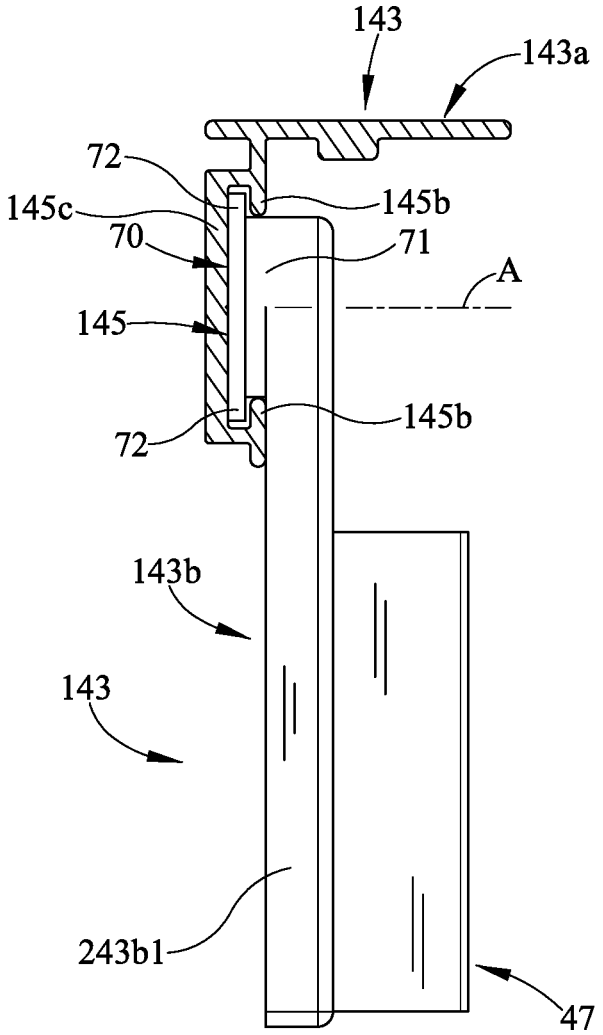
FIG. 14A is a sectional view taken along line 14A-14A of FIG. 11 illustrating one embodiment of the second rail or rail member in a locked position and at least one pivot position.
Figure 14B:
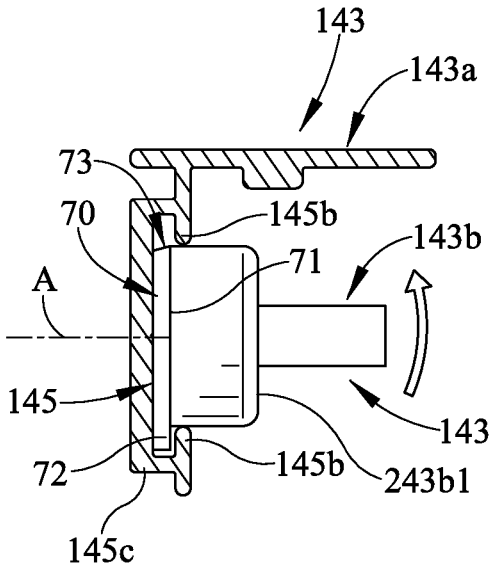
FIG. 14B is a sectional view taken along line 14B-14B of FIG. 11 illustrating one embodiment of the second rail or rail member in an unlocked position and another pivot position.
Figure 15:
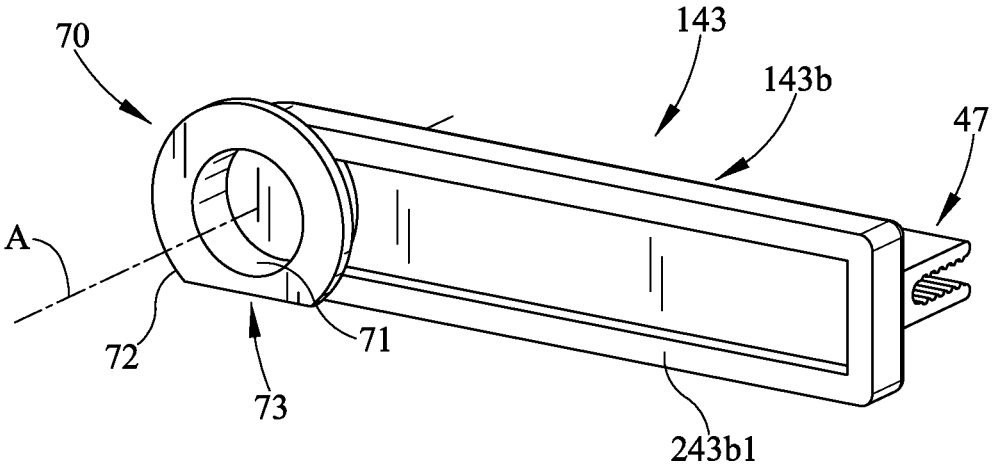
FIG. 15 is a rear perspective view of one embodiment of one member of the rail or framework.

In some implementations, the one or more members defining the second rail 143*b*, clips 148, and/or rails 143 may include one or more attachment mechanisms 70 to vary the framework defining one or more cells 42 of the plurality of cells or system 110. In the embodiment shown in the figures, the one or more attachment mechanisms 70 may allow the member(s) (e.g. 243*b*1 and/or 243*b*2), clips 148, or second rail 143*b* to pivot to one or more angles θ between a range of angles θ relative to rail 143 from which it is attached. The first and/or second member 243*b*1, 243*b*2 may be pivotably connected to their corresponding one or more rails 143. The attachment mechanism 70 may pivot the first member 243*b*1, 243*b*1 or member/rail within the longitudinal groove 145 of the rail 143 between a plurality of pivot positions (see FIGS. 8 and 11 for examples) about the axis A. In the one embodiment shown, the attachment mechanism 70 may include a protrusion 71 received within the groove 145 of the rail 143. The protrusion 71 may allow pivoting within the groove 145 to allow the user to orientate the rail or member in the desired angle θ for one or more applications or cells. As shown in FIGS. 11 and 14A-15, the protrusion 71 may be positioned along one or more positions of the length of the member 243*b*1, 243*b*1 and/or rail. For example, as shown, the protrusion 71 or attachment mechanism 70 may be positioned proximate at least one end of the member (e.g. first member 243*b*1). Moreover, in some embodiments, the protrusion 71 or attachment mechanism 70 may be positioned proximate the midpoint of the member or spaced from one or more ends (e.g. member 243*b*2). As shown in FIGS. 11 and 14B, the attachment mechanism 70 or protrusion 71 may include at least one orientation or pivot position relative to the groove 145 or rail 143 to engage/disengage the attachment mechanism. For example, as shown, when in the unlocked position (see FIG. 14B) the attachment mechanism 70 may be disengaged/engaged to the rail 143. The unlocked position may be when the member is parallel to first rail 143*a* and/or is at 0 or 180 degrees relative to the rail 143/first rail 143*a* or groove 145. Upon engagement, the member of the second rail 143*b* may be pivoted about the axis A of the attachment mechanism or protrusion thereby locking the member or second rail in a locked position (see FIG. 14A) to the first rail or groove 145. In some embodiments, the attachment mechanism 70 may allow the member to slide within the groove 145 along the length of the rail 143. In the one embodiment shown, the protrusion may include a truncated outer periphery 73 or flange 72. The truncated outer periphery 73 may allow the member to be inserted or pass into the groove 145. Once inserted and pivoted, the remaining flange 72 or outer periphery 73 engages the groove 145, the groove over hang portion 145*b*, and/or rail and may be held or retained within or locked with the groove in the locked position thereby allowing pivoting between a plurality of pivot positions for one or more applications. This interference fit between the outer periphery 73/flange 72 and the groove 145 allows for the retention of the members or second rail.

The two or more members of the rail or framework rail (e.g. second rail) may be a variety of constructions, quantities, shapes, and sizes and still be within the scope of the invention. The first member 243*b*1 may include the attachment member 70 on one end. In some embodiments the attachment mechanism or protrusion may be spaced from the ends as shown in the second member 243*b*2. The second member 243*b*2 may extend from the attachment mechanism 70 in two or more directions and include one or more trim engagement mechanisms 47, if used. The one or more members may receive a variety or quantities of trim or spacers to position the one or more panels. As shown in FIGS. 11 and 14B, the members or rails 143 may space the panels from each other without trim in some applications.

Figure 12:
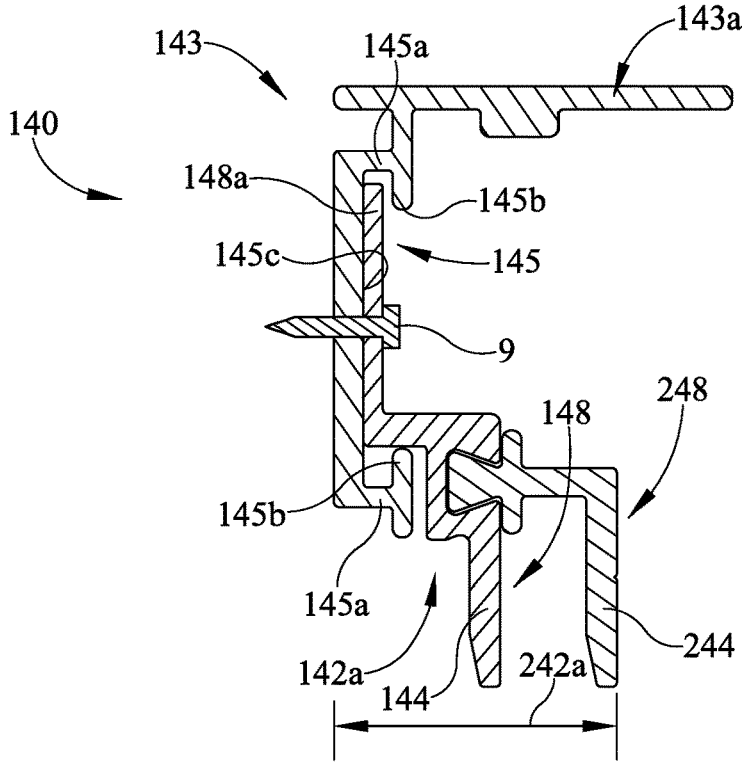
FIG. 12 is a sectional view taken along line 12-12 of FIG. 8 illustrating an embodiment of the projecting clip on the rail of the outer periphery of the wall panel system as well as a second or another projecting clip, if used, attached to the projecting clip of FIG. 8 having at least one flange to vary or change the spacing of the wall panel and/or engagement of the retention devices from the wall.
Figure 13:
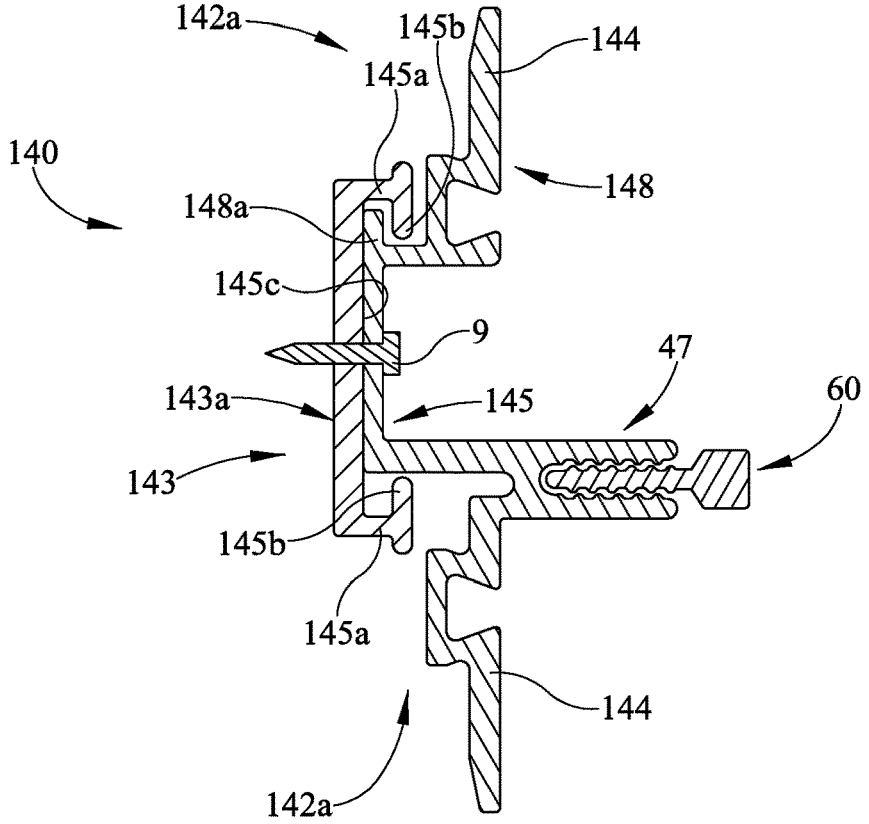
FIG. 13 is a sectional view taken along line 13-13 of FIG. 8 illustrating an embodiment of the projecting clip positioned on a rail inside the outer periphery of the wall panel system.
Figure 17:
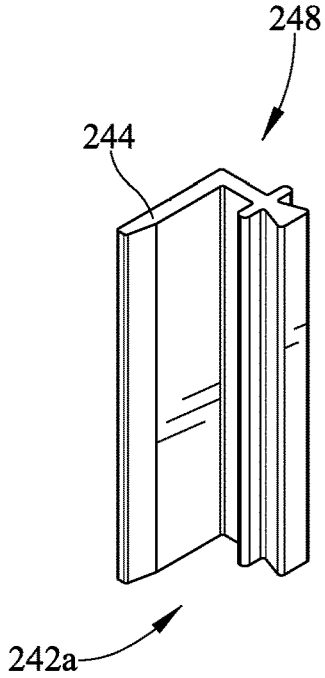
FIG. 17 is a perspective view of the second projection clip of FIG. 12.

In some implementations, the framework 40 and/or projection clip 148 may include another/second extension or projection clip 248 between the rail 143 and wall panel 20 in some applications. As shown in FIG. 12, the second projection clip 248 or flange 244 may space the wall panel 20, trim 60, projection clip 148 and/or other portions of the system further from the wall or mounting surfaces 1, rail 143, clip 143 and/or one or more wall panels 20 than using the projection clip 148. In some embodiments, different panels, trim, or other system structure may be used with the projection clip 248. The two or more projection clips 148 and 248 used in an application may, in some embodiments, provide for a three-dimensional look of panels. For example, in one implementation, projection clips 148 may secure and space one or more panels 20 in one or more cells 42 and the combined clips 148 and 248 in another one or more cells 42 may space one or more panels 20 further out from the adjacent panels that only use clips 148. As shown in FIG. 12, the projection clip or clips 248, if used, may define at least a portion of the space 242*a* and/or flange 244 for releasable engagement with the one or more retention devices 50 (e.g. 51 and/or 52). The space 242*a* defined by clip 248 and/or flange 244 may be larger than the space 142*a* defined by clip 148 and/or flange 144. The projection clip 248 may extend from the one or more rails 43 and/or clips 148 to define the inner periphery 41 of the cell 42. The clip 248 may engage or extend from the clip 148 in a variety of ways. As shown in FIGS. 12 and 17, the projecting clip 248 may be received by, but is not limited to, a dovetail engagement with the projecting clip 148. The projecting clip 248 may be assembled with the projecting clip 148 by sliding the two clips together in the direction of the longitudinal axis to engage/disengage the dovetail engagement. The projection clip 148 and/or 248 may be a variety of sizes, shapes, lengths, quantities, and constructions and still be within the scope of the invention.

In use, the wall panel system 10 may be utilized in a variety of applications. Installing, uninstalling, repair, replacement, reconfiguring, décor changing, or maintenance of the wall panel system or portions thereof and/or providing access behind the wall panel system 10 may include a variety of steps. In some applications, a second trim 60 and/or wall panels 20 may replace a first trim and/or wall panels already assembly to create another outward ornamental wall covering appearance different from what was replaced or changed. In some implementations, when installing, the user may secure the framework 40 to a wall or multiple objects 1 in a variety of patterns, shapes, sizes, etc. to define the plurality of the cells 42. The user attaches one or more panels 20 to one or more cells 42 via the one or more retention devices 50 (e.g. 51 and/or 52). The retention devices 51 lock and unlock the wall panel 20 from each cell 42. When the wall panel 20 is in the aligned position, the one or more retention devices 51 may be deployed from the stowed position to lock the wall panel 20 to the framework 40. When in the deployed position, the retention devices 51 of portions thereof engage the framework, channel, flange, projection clip, or space. Unlocking the wall panel may include actuating the one or more retention devices 51 to the stowed position and separating the wall panel 20 from the framework 40. When in the stowed position, the retention device 50 or portion thereof may be disengaged from the framework, channel, space, projection clip, or flange. Unlocking/locking the wall panel may include actuating the one or more retention devices 51 between the stowed and deployed positions. In one embodiment, the actuation may be operated by, but not limited to, magnetic forces.

Moreover, the step of engaging the one or more retention devices 50 may include operably engaging a first and second retention device of the wall panel 20 with the framework 40. Wherein in some embodiments as shown, the first retention device 51 is different from the second retention device 52. In using a second retention device 52 that may be fixed (e.g. clip) and another or first retention device 51 (e.g. movable pin) that may be actuated between stowed and deployed position. The second retention device 52 may be engaged to the framework 40 before the first retention device 51 locks or secures the wall panel to the framework. Moreover, the first retention device 51 may be unlocked before disengaging the second retention device 52 and wall panel from the framework. When attaching the wall panel 20, the second retention device 52 may be engaged with the framework 40 or rail 43. As shown in FIG. 3, the second retention device 52 may be initially engaged with framework in the misaligned orientation/position of the wall panel 20 relative to the framework. With the second retention device at least partially engaged, the wall panel 20 may be pivoted or moved in a direction towards the framework or to the aligned position. In some embodiments, the first retention device 51 may be in stowed position when pivoting from the misaligned position to the aligned position of the wall panel. Once in the aligned position, the first retention device or portion thereof may be actuated to the deployed position to lock the panel in the aligned position. Actuation may be operated by a magnetic force in some embodiments. The first retention device 51 may be actuated to unlock and separate the wall panel from the framework 40. The one or more panels 20 may be installed independently of the other panels or removed separately out of successive order. For example, the wall panel may be pivoted when adjacent wall panels may already be assembled to the framework (e.g. in the aligned orientation and having both the first and second retention devices engaged to the framework). Further, if trim 60 is used, the one or more trim or portions thereof may be secured to or separated from the remaining framework surrounding the one or more wall panels before/after the one or more wall panels are attached. Moreover, a projection clip, if used, may be secured to the remaining portion of the framework to attach the wall panel 20 and/or trim in some embodiments. Further, trim members may be replaced, repaired, or rearranged by different trim members in some applications.

In some implementations, the framework may be installed when convenient for installation and/or to accommodate project deadlines. For example, the framework 40 may be installed at a different or earlier time before the wall panels 20 are needed to be installed. The framework 40 may be attached to the mounting surface 1 for a variety of time periods or durations before panels are attached. For example, if needed to meet installation deadlines the framework 40 can be installed at a desired deadline than the panels, if awaiting panel delivery or manufacture, allow inspection of framework, wall structure, utilities, etc., and/or waiting to attach panels to reduce exposure to potential damage during surrounding construction or activity.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A wall panel system comprising:

a framework defined by a plurality of first rails and a plurality of second rails to define a plurality of cells, and one or more projection clips attached to at least one of the plurality of first rails and the plurality of second rails, wherein the one or more projection clips includes an inwardly extending flange defining a space from a wall;

a plurality of panels having a front face and a rear face defined by an outer periphery, wherein at least one of the plurality of panels is received within at least one of the plurality of cells;

the rear face of at least one panel of the plurality of panels include a first retention device engaging at least one of the one or more projection clips, and wherein the first retention device includes a stowed position and a deployed position, wherein when in the deployed position the first retention device includes a portion deployed into the space defined by the inwardly extending flange of the at least one of the one or more projection clips; and wherein the first retention device is a magnetically actuated pin extending linearly between the stowed position and the deployed position.

2. The wall panel system of claim 1 wherein the rear face of the at least one panel of the plurality of panels include a second retention device engaging at least one of the one or more projection clips.

3. The wall panel system of claim 1 wherein the at least one rail of the plurality of first rails includes a longitudinal groove, wherein the longitudinal groove receives the one or more projection clips.

4. The wall panel system of claim 1 wherein at least one rail of the plurality of second rails includes a first member and a second member defining at least one cell of the plurality of cells.

5. The wall panel system of claim 4 wherein the first member engages at least one rail of the plurality of first rails and wherein the second member engages another rail of the plurality of the first rails adjacent thereto.

6. The wall panel system of claim 5 wherein the second member of the at least one rail of the plurality of second rails defines a portion of two adjacent cells of the plurality of cells.

7. The wall panel system of claim 4 wherein the at least one rail of the plurality of second rails is positioned at least one of perpendicular or angled relative to at least one rail of the plurality of first rails defining the at least one cell of the plurality of cells.

8. The wall panel system of claim 4 wherein the at least one rail of the plurality of second rails is angled relative to the at least one rail of the plurality of first rails defining the at least one cell of the plurality of cells, and not perpendicular thereto.

9. A wall panel system comprising:

a framework defining a plurality of cells, each of the plurality of cells includes one or more projection clips engaging one or more rails, wherein the one or more projection clips includes an inwardly extending flange defining a space from a wall;

a plurality of panels having a front face and a rear face defined by an outer periphery, wherein at least one of the plurality of panels is received within at least one of the plurality of cells;

at least one panel of the plurality of panels includes a retention device releasably engaging at least one clip of the one or more projection clips, wherein the retention device includes a magnetically actuated portion deployed into the space defined by the inwardly extending flange of the at least one clip of the one or more projection clips.

10. The wall panel system of claim 9 further comprising one or more second rails engaging the one or more rails to define at least one cell of a plurality of cells, wherein the one or more second rails includes a first member engaging one rail of the one or more rails and a second member engaging another rail of the one or more rails.

11. The wall panel system of claim 10 wherein the one or more rails includes a longitudinal groove adapted to receive the one or more projection clips and the first member, the second member, or both the first member and the second member.

12. The wall panel system of claim 11 wherein each one of the first member and the second member includes an attachment mechanism to vary the framework defining at least one cell of the plurality of cells.

13. The wall panel system of claim 12 wherein the attachment mechanism pivots the first member within the longitudinal groove of the one rail of the one or more rails between a plurality of pivot positions.

14. The wall panel system of claim 10 wherein the one or more second rails is positioned in pivot positions other than perpendicular to the one or more rails.

15. The wall panel system of claim 10 wherein the first member is different from the second member.

* * * * *